US006336012B1

(12) United States Patent
Noda et al.

(10) Patent No.: US 6,336,012 B1
(45) Date of Patent: Jan. 1, 2002

(54) DEVELOPING DEVICE, PROCESS CARTRIDGE AND ELECTRIC ENERGY SUPPLY PART TO DEVELOPING ROLLER

(75) Inventors: Shinya Noda; Yoshikazu Sasago; Teruhiko Sasaki; Yoshiyuki Batori; Takashi Akutsu, all of Toride; Ichiro Terada, Abiko, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/559,144

(22) Filed: Apr. 27, 2000

(30) Foreign Application Priority Data

Apr. 30, 1999 (JP) ..... 11-123646
Apr. 30, 1999 (JP) ..... 11-123647

(51) Int. Cl.[7] ..... G03G 15/00
(52) U.S. Cl. ..... 399/90; 399/270
(58) Field of Search ..... 399/90, 270, 271, 399/285, 88, 107, 111, 277; 439/17; 492/8, 60

(56) References Cited

U.S. PATENT DOCUMENTS 5,283,619 A * 2/1994 Nomura et al. ..... 399/90
5,305,062 A * 4/1994 Sato et al. ..... 399/90
5,634,175 A 5/1997 Michlin et al. ..... 399/90
5,648,838 A * 7/1997 Michlin et al. ..... 399/119
5,682,587 A * 10/1997 Higeta et al. ..... 399/277
5,739,900 A 4/1998 Isobe
5,768,658 A * 6/1998 Watanabe et al. ..... 399/111
5,815,782 A * 9/1998 Yokomori et al. ..... 399/285
5,822,654 A 10/1998 Damji et al. ..... 399/111
6,151,465 A * 11/2000 Toba et al. ..... 399/90
6,249,659 B1 * 6/2001 Stickler ..... 399/90

FOREIGN PATENT DOCUMENTS

EP 0549400 A2 6/1993
EP 0754984 A2 1/1997

* cited by examiner

*Primary Examiner*—Robert Beatty
(74) *Attorney, Agent, or Firm*—Fitzpatrick, Cella, Harper & Scinto

(57) ABSTRACT

A developing device includes a frame; a developer carrying member including a first cylindrical portion and a second cylindrical portion provided at an end of the first cylindrical portion; and a magnet provided in the developer carrying member, extending from inside of the developer carrying member to outside thereof. A first electroconductive portion is supported on the magnet; and a second electroconductive portion is electrically connected with an inner surface of the first cylindrical portion and in slidable contact with the first electroconductive portion. A third electroconductive portion includes a first contact portion electrically connected with the first electroconductive portion and a second contact portion. The third electroconductive portion is electrically connected with an electrical contact of a main assembly of an image forming apparatus so that a developing bias is applied to the developer carrying member.

38 Claims, 16 Drawing Sheets

DEVELOPING DEVICE, PROCESS CARTRIDGE AND ELECTRIC ENERGY SUPPLY PART TO DEVELOPING ROLLER

FIELD OF THE INVENTION AND RELATED ART

The present invention relates to a developing device for an image forming apparatus, a process cartridge and an electric energy supply part therefor.

Here, the image forming apparatus forms an image on a recording material through an electrophotographic process for example. Examples of the electrophotographic apparatus include an electrophotographic copying machine, electrophotographic printer (for example a laser beam printer, LEDprinter or the like), facsimile machine, word processor and the like.

The process cartridge contains an image bearing member and at least one charging means, developing means and cleaning means, which are unified into a cartridge which is detachably mountable to an image forming apparatus.

In the field of an electrophotographic image forming apparatus using an electrophotographic image forming process, a process cartridge type is used in which an electrophotographic photosensitive drum and process means actable on the electrophotographic photosensitive drum are unified into cartridge which is detachably mountable to a main assembly of an electrophotographic image forming apparatus. With this process cartridge type, the maintenance operation for the electrophotographic image forming apparatus can be carried out in effect by the users, so that operativity is remarkably improved. Therefore, the process cartridge type is widely used in the field of image forming apparatus.

In the process cartridge, an electrostatic latent image formed on the electrophotographic photosensitive member is developed by developing means which develops the electrostatic latent image formed on the electrophotographic photosensitive member with the toner (developer) by a developing roller which is a developer carrying member. More particularly, a developing bias is applied to the developing roller to transfer the toner onto the electrophotographic photosensitive member from the developing roller in accordance with the electrostatic latent image so that visualized toner image is provided.

As for the method for applying a developing bias the developing roller, as shown in FIG. 10, a flange member F of an electroconductive material is provided at the end of the developing roller D, and an electrode in the form of a compression coil spring Sp is mounted to the flange member F for electrical conduction. When the developing device is mounting to the main assembly of the operators, the contact member C is electrically connected to an electric energy supply member V provided in the main assembly of the apparatus.

As for another method of applying a developing bias the developing roller, as shown in FIG. 11 an elastic contact portion Cs is provided in the contact member C, and the elastic contact portion Cs is contacted to flange member F of electroconductive material at an end of the developing roller D. When the developing device is mounted to the main assembly of the apparatus, the contact member C is electrically connected to the electric energy supply member V provided in the main assembly of the apparatus.

In such a case, the compression coil spring Sp or the flange member F is rotated integrally with the developing roller D so that it is in sliding relation with the contact member C, and therefore, generally, electroconductive grease is applied the sliding portion Cp.

SUMMARY OF THE INVENTION

Accordingly, it is a principal object of the present invention to provide a developing device and an assembling method in which a contact portion for applying a developing bias to a developer carrying member is improved in reliability.

It is another object of the present invention to provide a process cartridge and an assembling method in which a contact portion for applying a developing bias to a developer carrying member. It is a further object of the present invention to provide an electric energy supply part in which an electric energy supply part for electric energy supply of developing bias to a developer carrying member has a magnet with which the positional accuracy in the developer carrying member is improved.

It is a yet further object of the present invention to provide an electric energy supply part for electric energy supply of developing bias away developer carrying member with which an electrical connection with an electroconductive portion on a magnet disposed inside said developer carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A description will be made as to the embodiment according to the present invention in conjunction with the accompanying drawings.

Referring to FIGS. 1 to 9, there are shown a developing device, a process cartridge having the developing device and an electrophotographic image forming apparatus to which the process cartridge is mountable.

First, referring to FIGS. 7 to 9, a description will be made as to the general arrangement of the electrophotographic image forming apparatus, and then, referring to FIGS. 1 to 6, a description will be made as to the contact structure for a developing roller. Then, referring to FIGS. 14 to 16, a description will be made as to a structure for preventing erroneous assembling.

(General Arrangement)

Figure 7:
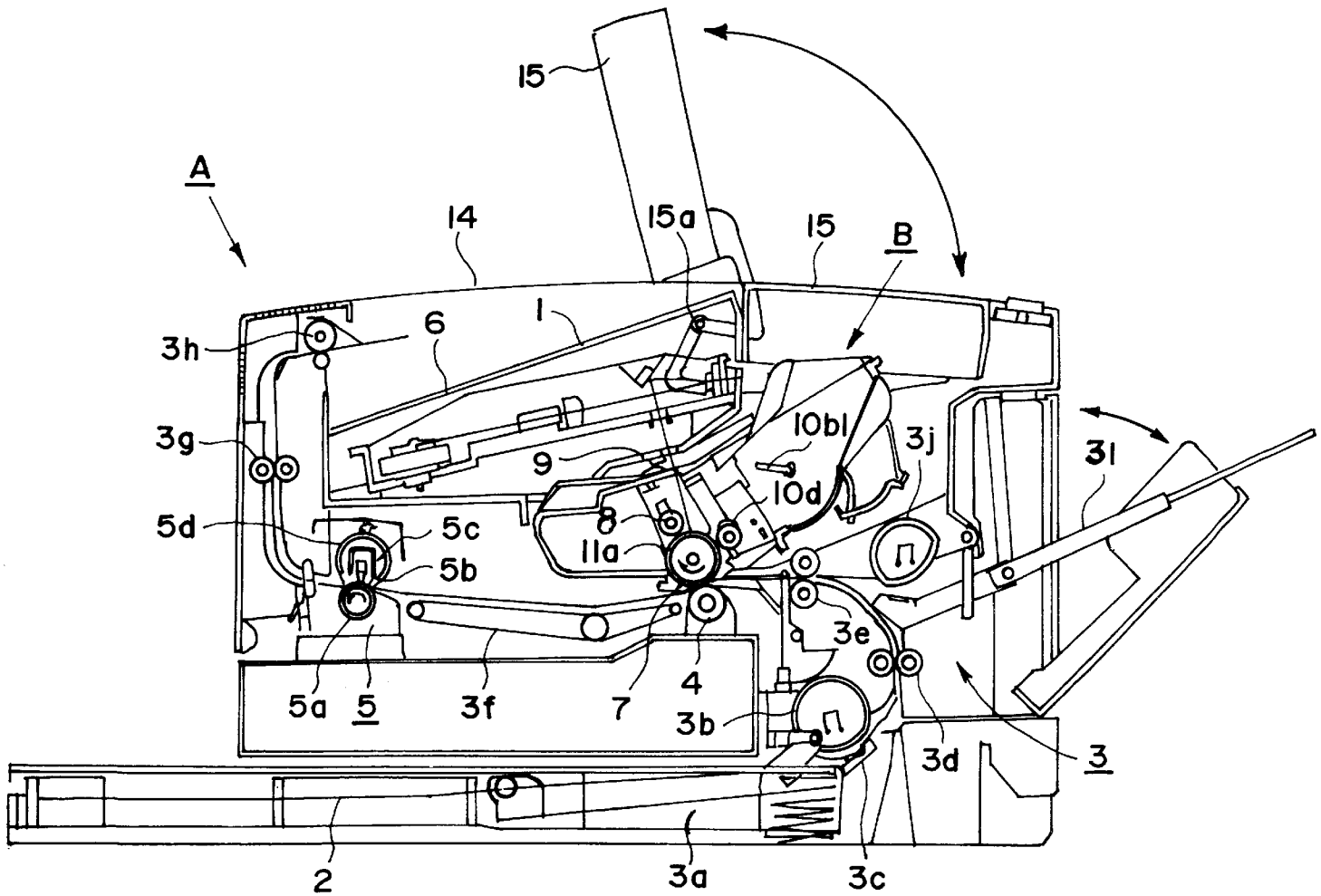
FIG. 7 is a schematic view of an electrophotographic image forming apparatus which is loaded with a process cartridge.

In the electrophotographic image forming apparatus (laser beam printer) A, as shown in FIG. 7, information light modulated in accordance with image information supplied from an optical system 1 is projected onto an electrophotographic photosensitive member in the form of a drum (photosensitive drum) 7 to form an electrostatic latent image thereon, and the sealing is developed withdeveloper into a toner image. In synchronism with the formation of toner image, a recording material 2 separately recording paper or an OHP sheet is supplied one by one from a cassette 3*a* by pick-up roller 3*b* and a press-contact member 3*c* press-contacted thereto and is fed by feeding means 3 including a pair of feeding rollers 3*d* and a pair of registration rollers or the like; and the toner image formed on the photosensitive member in the process cartridge B is transferred onto the recording material 2 by application of a voltage to the transfer roller 4 (transferring means), and the recording material 2 is fed to fixing means 5 by a conveyer belt 3*f*. The fixing means 5 includes a driving roller 5*a* and a fixing rotatable member 5*d* including a supporting member 5*c* and a cylindrical sheet rotatably supported on the supporting member 5*c*, by which heat and pressure are applied to the recording material 2 which is passing through the fixing means, by which the transferred toner image is fixed on the recording material 2. The recording material 2 is fed by a pair of discharging rollers and is discharged to a discharging portion 6 through a reverse feeding path. The image forming apparatus A is capable of receiving a sheet manually fed by manual insertion tray 3*i* and a roller 3*j*.

(Process Cartridge)

On the other hand, the process cartridge B contains an image bearing member in the form of an electrophotographic photosensitive member and at least one process means. The process means include charging means for charging the electrophotographic photosensitive member, developing means for developing a latent image formed on the electrophotographic photosensitive member, a cleaning means for removing toner remaining on the surface of the electrophotographic photosensitive member.

Figure 8:
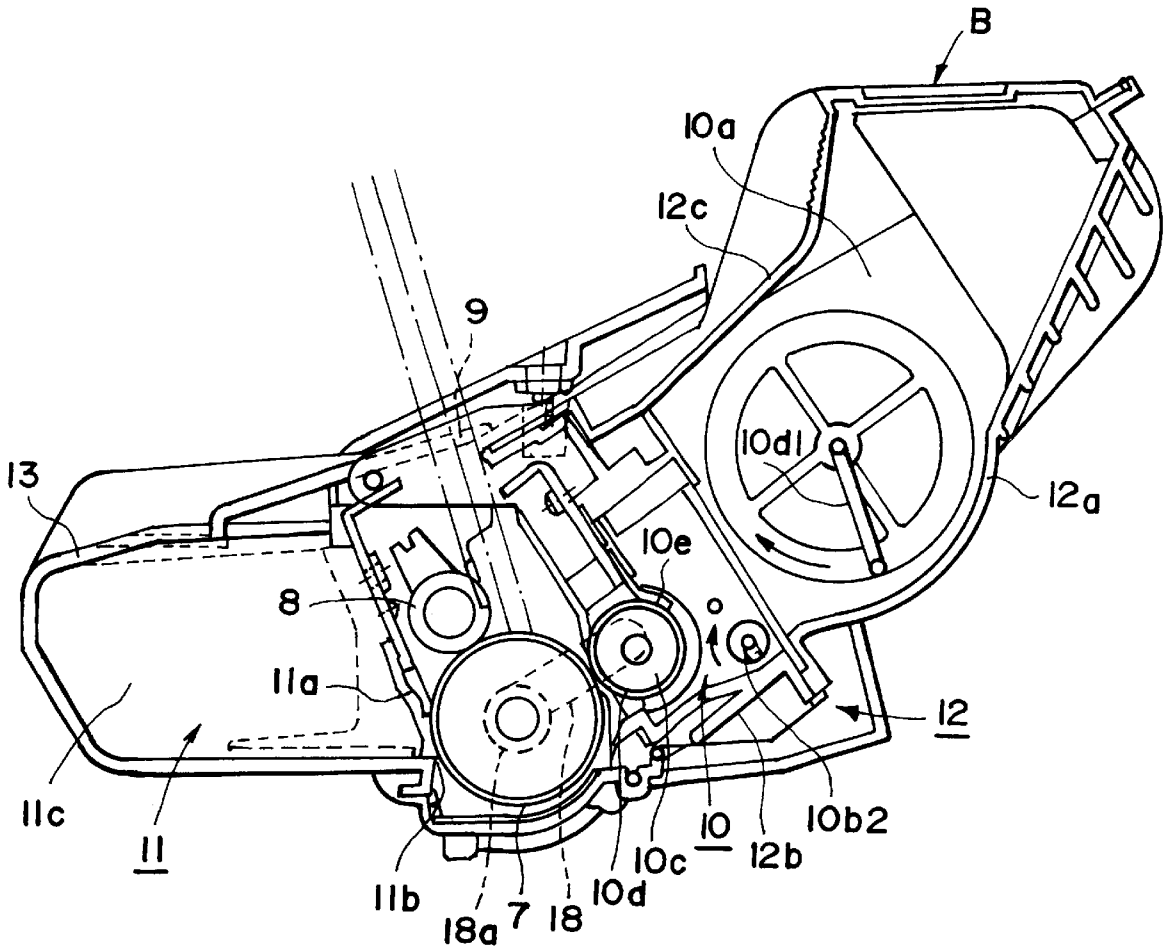
FIG. 8 is an illustration of a structure of a process cartridge.
Figure 9:
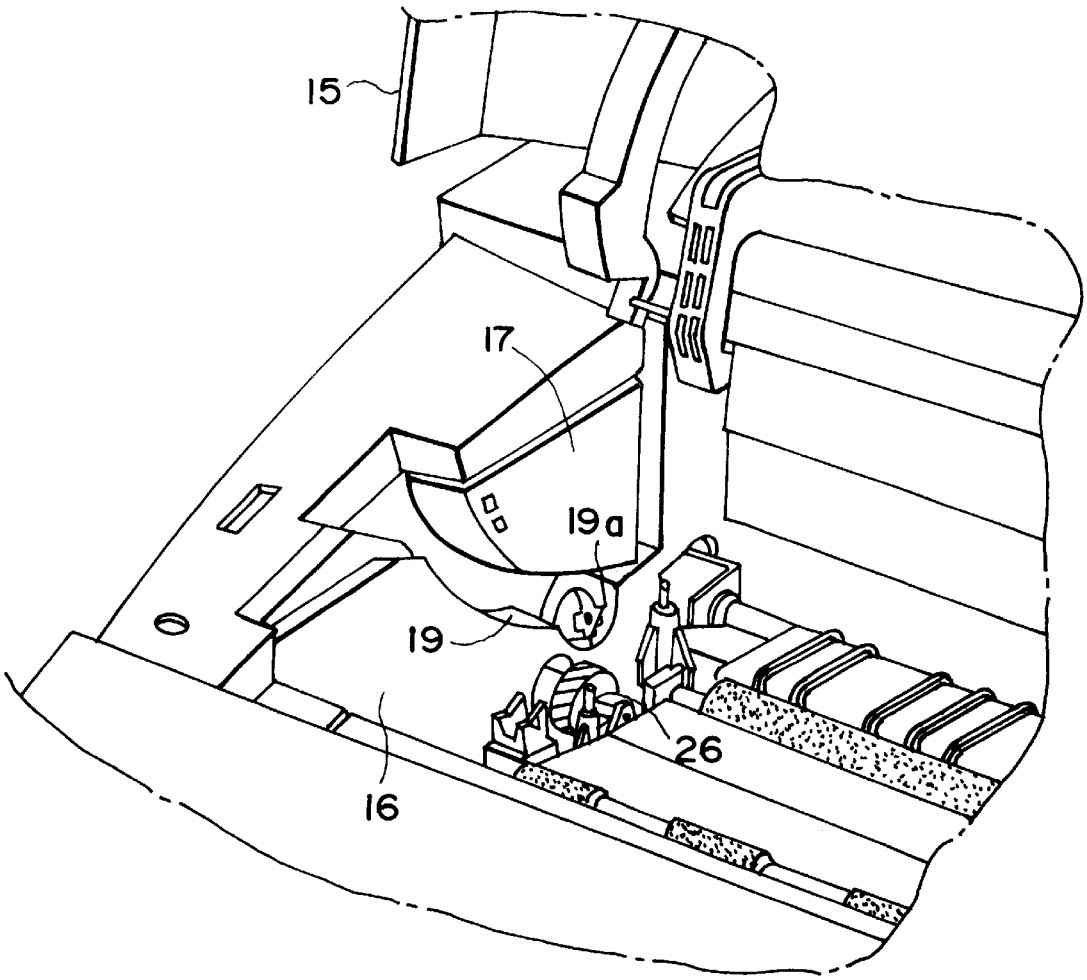
FIG. 9 is an illustration of a mounting structure of a process cartridge.
Figure 10:
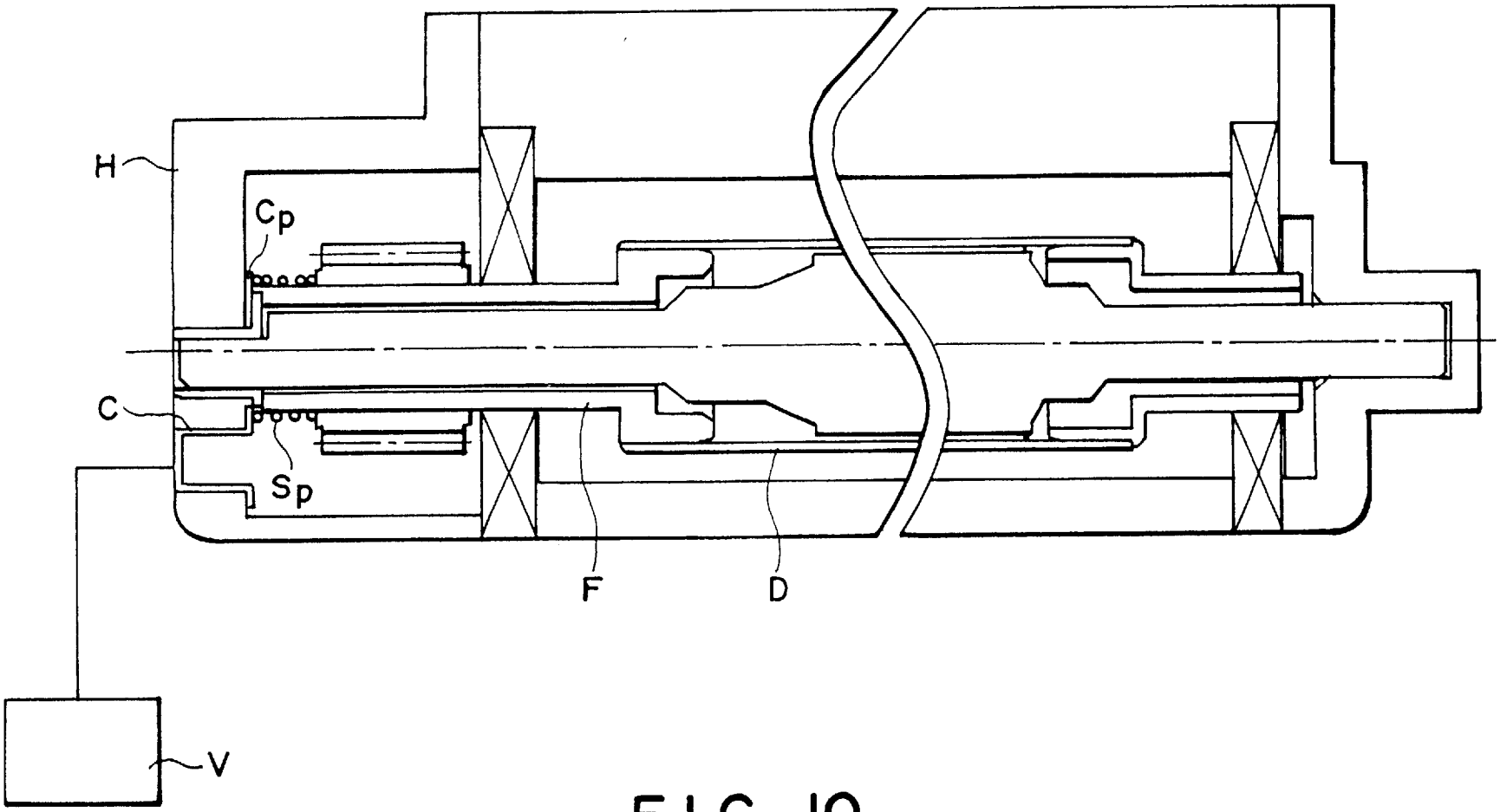
FIG. 10 PRIOR ART
FIG. 10 is a schematic illustration of a contact structure of a developing roller.
Figure 11:
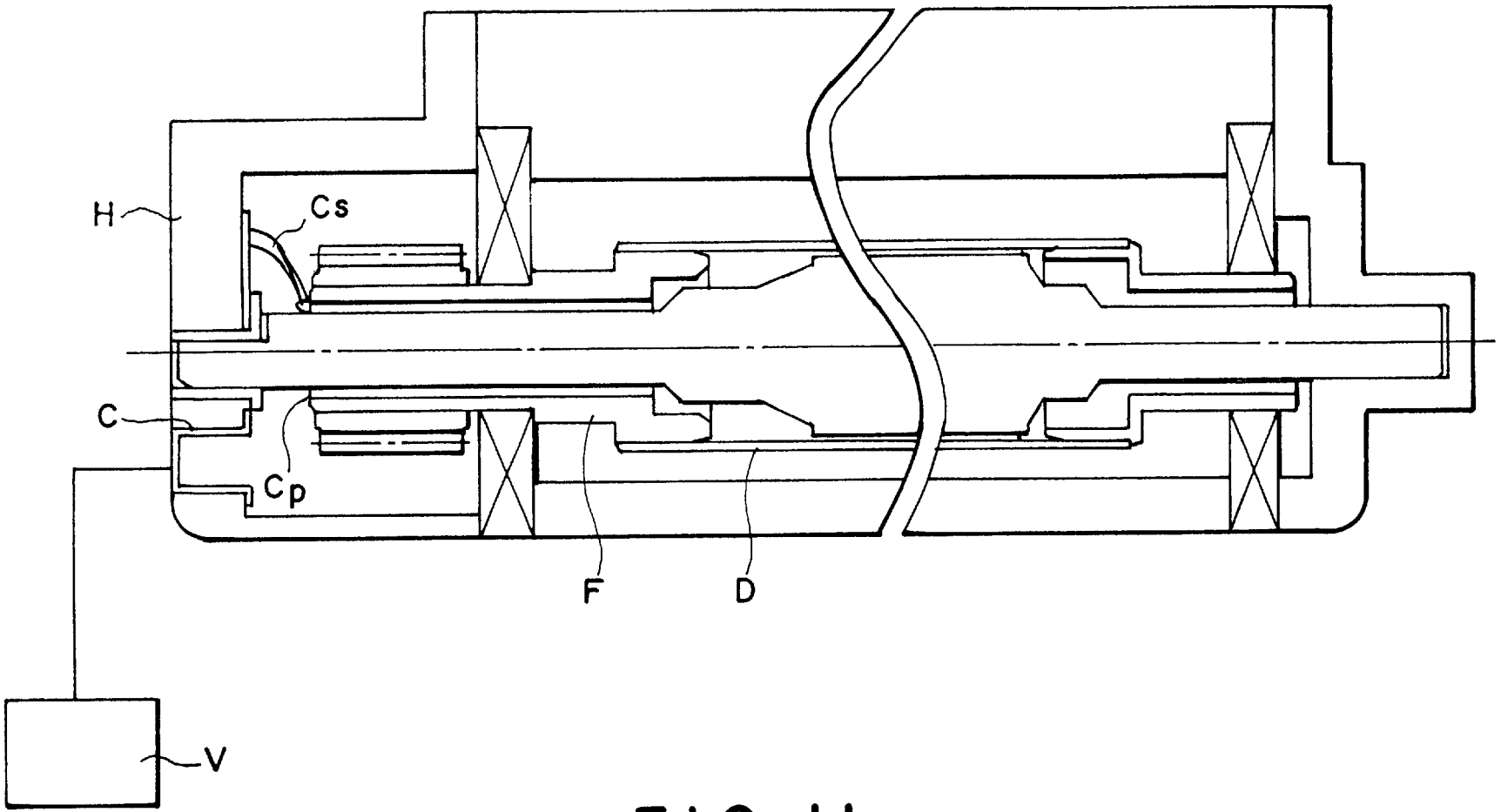
FIG. 11 PRIOR ART
FIG. 11 is a schematic illustration of a contact structure of a developing roller.

As shown in FIG. 8, with the process cartridge B of this embodiment, the electrophotographic photosensitive member having a photosensitive layer (a photosensitive drum 7) is rotated, and the surface of the photosensitive drum 7 is uniformly charged by charging means in the form of a charging roller 8 supplied with a voltage, and then, the charged photosensitive drum 7 is exposed to a light image from the optical system 1 through an opening 9 to form an electrostatic latent image. The latent image is developed by developing means 10 (developing device).

The developing means 10 is fed the toner out of the toner accommodating portion 10*a* by rotatably first feeding member 10*b*1 and first second feeding member 10*b*2. The developing roller 10*d* (developer carrying member) containing therein a fixed magnet (magnet) 10*c* is rotated, and a toner layer of toner particles triboelectrically charged by the developing blade 10*e* is formed on the surface of the developing roller 10*d*, and a developing bias is applied to transfer the toner to the photosensitive drum 7 in accordance with the latent image so that visualized toner image is formed.

A transfer roller 4 is supplied with a voltage having a polarity opposite from that of the toner image to transfer the toner image onto the recording material 2. Thereafter, the residual toner remaining on the photosensitive drum 7 is removed or scraped off by the cleaning blade 11*a*, and is received by the receptor sheet 11*b*, thus the residual toner is collected by the cleaning means.

The process cartridge B of this embodiment comprises a developing device frame 12*a* having a toner accommodating portion 10*a*, a development lower frame 12*b*, and a toner developing device frame 12 having a cap member 12*c* integrally welded therewith which contains the developing roller 10*d*, the developing blade 10*e* and the like. The toner developing device frame 12 is coupled with a cleaning frame 13 accommodating the photosensitive drum 7, the charging roller 8, the cleaning means 11 and the like to constitute the cartridge which is detachably mountable to a cartridge mounting means provided in the main assembly 14 of the image forming apparatus.

As shown in FIG. 7, when the process cartridge B is mounted or demounted, an opening and closing member 15 is open by rotation about a shaft 15*a*, and when the opening and closing member 15 is opened, there is a cartridge mounting space in the main assembly 14 of the apparatus. A frame 16 provided at each of left and right sides of the mounting space is provided with a cartridge mounting guide member 17 as shown in FIG. 9 in which only one of the guide members 17 are shown. On the other hand, a boss 18 (FIG. 8) is provided protected at the longitudinally outsides of the process cartridge B, and the process cartridge B is inserted so that bosses 18 are engaged with the guide grooves 19 formed by the guide member 17 and the frame 16. In the rear portion of the groove 19, a recess 19*a* is formed, and a shaft portion 18*a* of the boss 18 is inserted into the recess 19*a* by which the process cartridge B is mounted. At this time, the drum gear (not shown) mounted to the longitudinal end of the photosensitive drum 7 is engaged with a driving gear provided in the main assembly 14 of the apparatus to commit drive transmission to the photosensitive drum 7.

(Contact Structure of Developing Roller)

Referring to FIG. 1 to FIG. 6, a description will be made as to a contact structure for applying a developing bias to the developing roller 10*d*.

Figure 1:
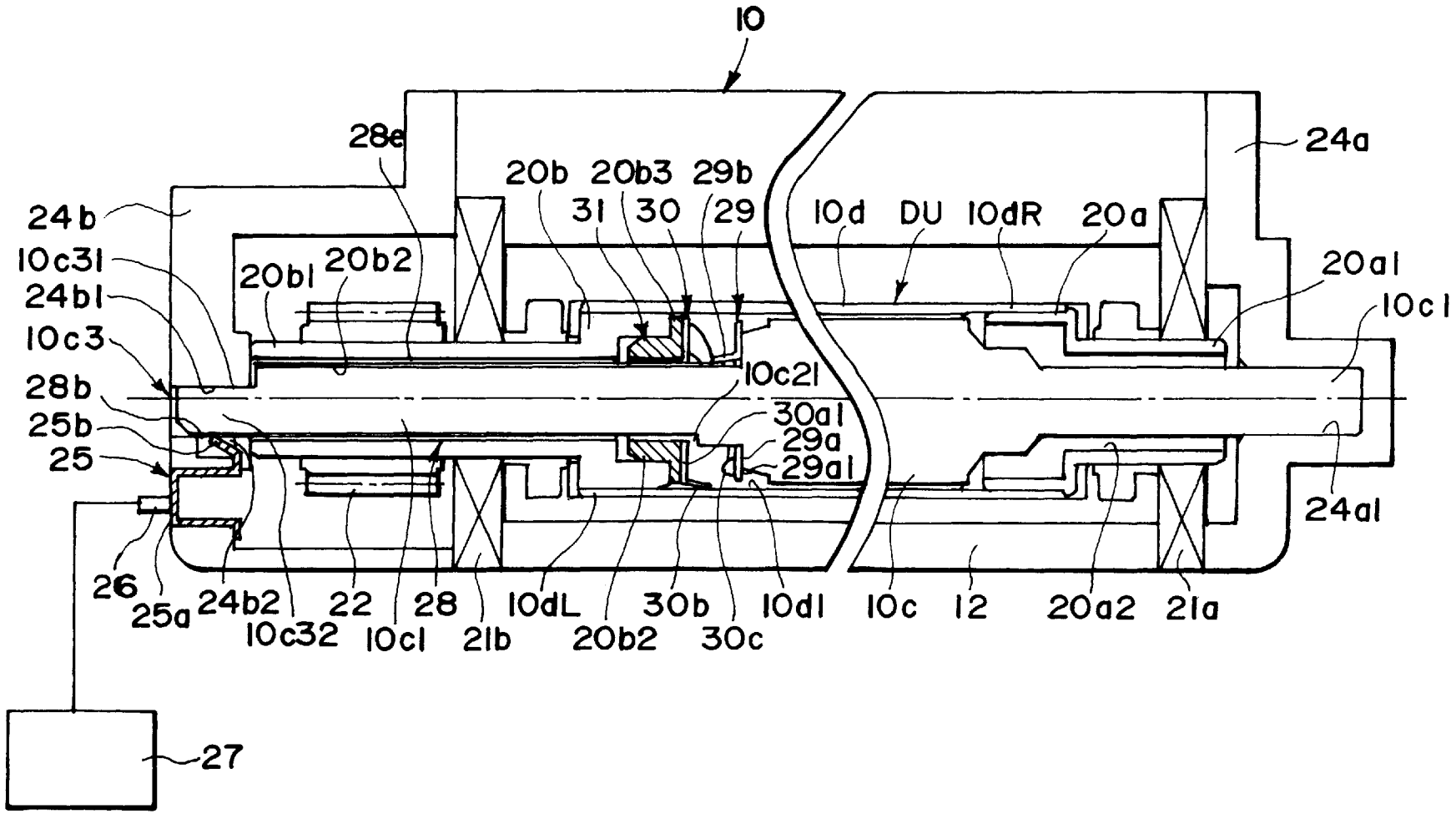
FIG. 1 is a schematic illustration of a contact structure of a developing roller according to an embodiment of the present invention.

As shown in FIG. 1, the developing roller (first cylindrical portion) 10*d* comprises a non-magnetic electroconductive cylindrical member of aluminum, stainless steel or the like and a flange member (second cylindrical portion) 20*a*, 20*b* at each of the opposite ends. The flange member has an outer diameter which is smaller than that of the first cylindrical portion. The righthand side flange member 20*a* is fixed to a right-hand end 10*d*R of the developing roller 10*d* by press-fitting, bonding, crimping or the like, and has a shaft portion 20*a*1 projected outwardly from a right-hand end 10*d*R in a longitudinal direction of the developing roller 10*d*. The outer periphery of the shaft portion 20*a*1 is rotatably supported by a bearing 21*a* fixed to the toner developing device frame 12 and the holder 24*a*. On the other hand, a flange member 20*b* of metal such as aluminum, stainless steel or the like is fixed to the left-hand end 10*d*L of the developing roller 10*d* by a press-fitting, crimping or another mechanical method, and comprises a shaft portion 20*b*1 functioning as a flange projected outwardly from the left-hand end 10*d*L in the longitudinal direction of the developing roller 10*d*. The outer periphery of the shaft portion 20*b*1 functioning as the flange is rotatably supported by a bearing 21*b* fixed to a toner developing device frame 12 and a holder 24*b*. To the shaft portion 20*b*1, a roller gear 22 is fixed by means of a key, a set screw or the like. With this structure, the driving force is transmitted from a drum gear (unshown) of a photosensitive drum 7 to the roller gear 22, so that developing roller 10*d* is rotated at a predetermined rotational speed. In this embodiment, the flange (shaft portion 20*b*1) is made of metal such as aluminum, stainless steel or the like. Therefore, the support rigidity for the developing roller 10*d* is improved. Thus, the rotational accuracy of the rotation is improved.

In this embodiment, the shaft portion 20*b*1 and the first electroconductive portion which will be described hereinafter are out of contact from each other. For this reason, no developing bias is supplied from the shaft portion 20*b*1 to the developing roller 10*d*.

A magnet 10*c* having a plurality of magnetic poles is contained in the developing roller 10*d*. The magnet 10*c* has shaft portions 10*c*1 at left and right ends. The left and right shaft portions 10*c*1 are penetrated through center holes 20*a*2, 20*b*2 of the flange members 20*a*, 20*b* and are fixed into the supporting holes 24*a*1, 24*b*1 of the holders 24*a*, 24*b* fixed to the toner developing device frame 12.

(First Electroconductive Portion (Cylindrical Electrode and Fixed Contact))

Figure 2:
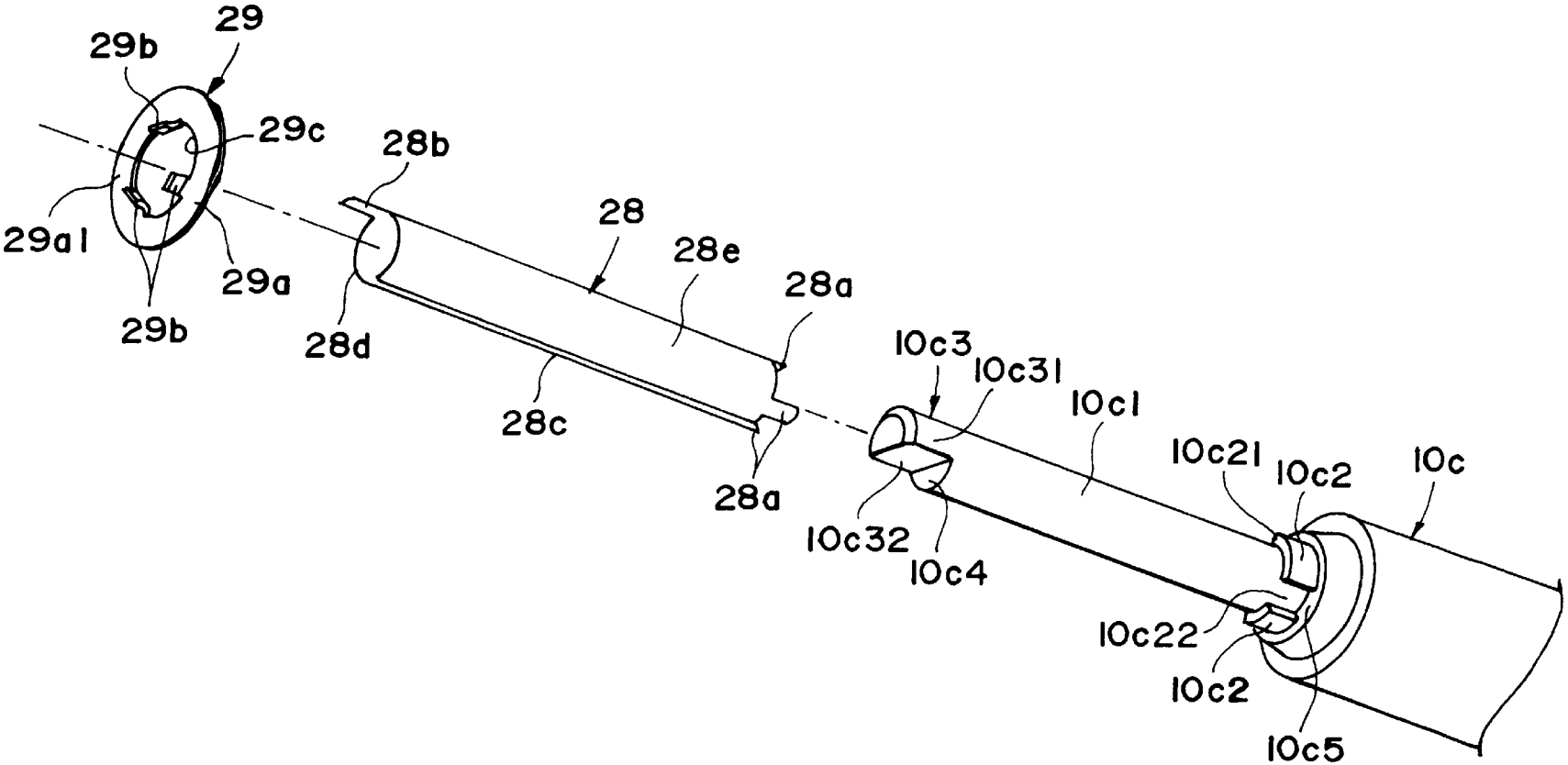
FIG. 2 is perspective views of a magnet and a fixed contact and a cylindrical electrode assembled with a magnet.
Figure 3:
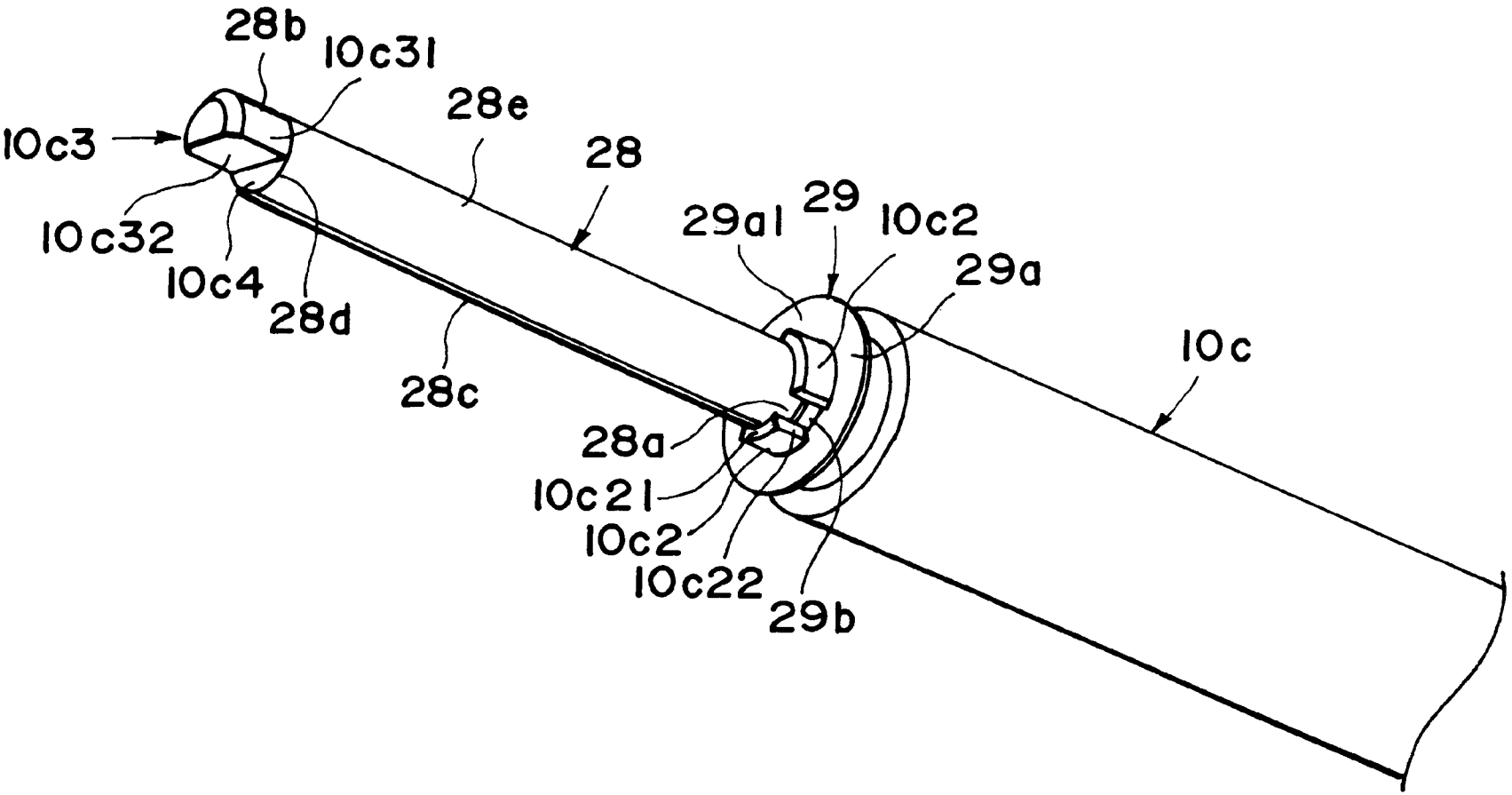
FIG. 3 is perspective views of a magnet, a fixed contact and cylindrical electrode assembled therewith.

As shown in FIGS. 2 and 3, a cylindrical electrode 28 and a fixed contact 29 having an electroconductivity is mounted to a shaft portion (left-hand shaft portion) 10*c*1 as one end shaft at one end (left side of the magnet 10*c*). The cylindrical electrode 28 and the fixed contact 29 constitute the first electroconductive portion.

The cylindrical electrode 28 is provided that left-hand shaft portion 10*c*1 of the magnet 10*c* and is extended in the longitudinal direction of the toner developing device frame 12 (the axial direction of the photosensitive drum 7). The cylindrical electrode 28 includes a cylindrical portion 28*e* in the form of a cylinder extending in the axial direction of the developing roller 10*d* at the center thereof, and is provided with projections 28*a*, 28*b* in the form of projected portions extending in the axial direction of the developing roller 10*d* at the left and right ends of the cylindrical portion 28*e*, respectively. The cylindrical portion 28*e* is provided with a slit 28*c* formed in the axial direction of the developing roller 10*d*. The inner diameter of the cylindrical portion 28*e* is slightly smaller than the outer diameter of the left-hand shaft portion 10*c*1 of the magnet 10*c*. Therefore, when the cylindrical portion 28*e* is engaged with the left-hand shaft portion 101*c*1 of the magnet 10*c*, the cylindrical portion 28*e* is expanded in the radial direction to slightly expand the slit 28*c*, and the cylindrical electrode 28 is fixed to the left-hand shaft portion 10*c*1 by the restoring force of the cylindrical portion 28*e* of the left-hand shaft portion 10*c*1.

At the base portion of the left-hand shaft portion 10*c*1 of the magnet 10*c*, there is provided a projection 10*c*2 projected in the radial election of the left-hand shaft portion 10*c*1 and extending toward the free end at each of several positions spaced circumstantially (three positions in this embodiment), and the end portion is provided with a D-cut 10*c*3 for positioning the magnetic pole of the magnet 10*c* in the rotational direction (angle). The cylindrical electrode 28 is fitted (telescoped) around the left-hand shaft portion 10*c*1 so that the projections 28*a* provided at the right-hand end of the cylindrical portion 28*e* are engaged with the recess 10*c*22 between adjacent projections 10*c*2 at the base portion of the left-hand shaft portion 10*c*1, respectively, by which the rotation of the cylindrical portion 28*e* relative to the left-hand shaft portion 10*c*1 is prevented. The telescopic motion of the cylindrical electrode 28 relative to the left-hand shaft portion 10*c*1 is stopped when the left-hand end end surface 28*d* of the cylindrical portion 28*e* reaches the bottom surface 10*c*4 of the D-cut 10*c*3 of the left-hand shaft portion 10*c*1. Here, the left-hand end side projection 28*b* projected from the end surface 28*d* of the cylindrical portion 28*e* is such that it covers the left-hand shaft portion 10*c*1 at the arcuate portion 10*c*31 of the D-cut 10*c*3 of the left-hand shaft portion 10*c*1, on the accurate surface. The outer diameter (a diameter of the circumscribed circle) of the projection 10*c*2 provided at a base portion of the left-hand shaft portion 10*c*1 of the magnet 10*c* is larger than the outer diameter (a diameter of the circumscribed circle) of the projection 28*a* provided at the right-hand end side of the cylindrical portion 28*e* of the cylindrical electrode 28, and is smaller than a rotational track of the rotational track of the sliding contact portion along which to the sliding arm 30*c* of the sliding contact 30 which will be described hereinafter slides of the fixed contact 29.

After the cylindrical electrode 28 is fixed to the left-hand shaft portion 10*c*1 of the magnet 10*c* in this manner, the fixed contact 29 is telescoped from the free and of the left-hand shaft portion 10*c*1 to the base portion.

Figure 17:
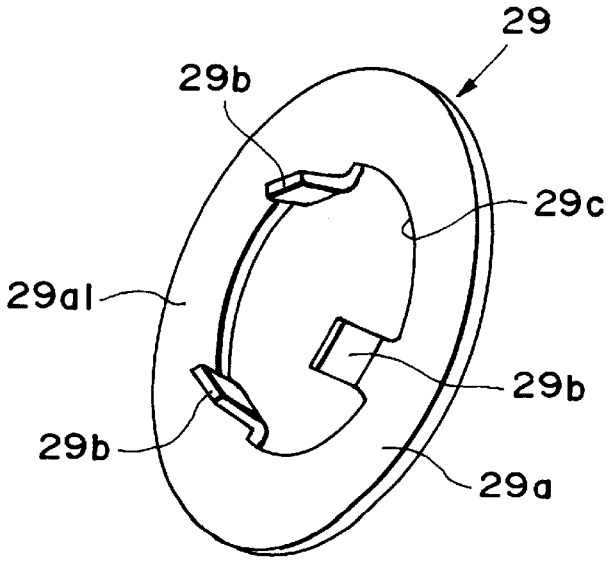
FIG. 17 is a perspective view of a fixed contact.

The fixed contrast 29 is electroconductive, and is electrically connected to the cylindrical electrode 28 to supply a developing bias coatings to the developing roller 10*d* through the sliding contact 30, thus functioning as an electric energy supply member. As shown in FIGS. 2 and 17, the fixed contact 29 comprises a circular disk portion 29*a* functioning as a base provided with a through hole 29*c* (circular hole) from which the left-hand shaft portion 10*c*1 is penetrated, and a positive claw portions 29*b* functioning as a contact portion extended inwardly from the disk portion 29*a* and bent toward downstream with respect to the telescoping direction to the left-hand shaft portion 10*c*1. The claw portion 29*b* is provided at each of three positions around the through hole 29*c*. The inscribed circle diameter of the free ends of the claw portions 29*b* is smaller than the outer diameter of the cylindrical portion 28*e* of the cylindrical electrode 28 described in the foregoing. When the fixed contact 29 is telescoped to the left-hand shaft portion 10*c*1 from the free end side (FIG. 2), the claw portion 29*b* deformed by the difference between the outer diameter of the cylindrical portion 28*e* of the cylindrical electrode 28 and the inscribed circle diameter at the free ends of the claw portions 29*b* to produce contact pressure and fixing force between the cylindrical electrodes 28 and the fixed contact 29. Thus, the fixed contact 29 is elastically contacted to and engaged to the cylindrical portion 28*e* of the cylindrical electrode 28 by the claw portions 29*b*. By the engagement of the claw portions 29*b*, the movement of the cylindrical portion 29*a* relative to the left-hand shaft portion 10*c*1 is limited in the circumferential direction. When the fixed contact 29 is further moved to the base portion of the left-hand shaft portion 10*c*,1 the fixed contact 29 is set such that claw portions 29*b* are received by the recesses 10*c*22 between the adjacent projection 10*c*2 provided at the base portion of the above-described left-hand shaft portion 10*c*1. By doing so, the claw portions 29*b* are contacted to the projection 28*a* at the right-hand end side of the cylindrical electrode 28, and the disk portion 29*a* is closely contacted to the shaft base portion 10*c*5 of the left-hand shaft portion 10*c*1. Here, the radius of the circumscribed circle of the projections 10*c*2 at the base portion of the left-hand shaft portion 10*c*1 of the magnet 10*c* is larger than the radius of the inscribed circle of the bent base portions of the claw portions 29*a* of the fixed contact 29. The height of the projections 10*c*2 measured in the axial direction is higher than the free end of the claw portion 29*a* of the fixed contact 29 when the fixed contact 29 is closely contacted to the shaft base portion 10*c*5, by which the contact portion (projection 28*a* and claw portion 29*b*) between the cylindrical electrode 28 and the fixed contact 29 are protected.

(The Second Electroconductive Portion (Sliding Contact)

Figure 4:
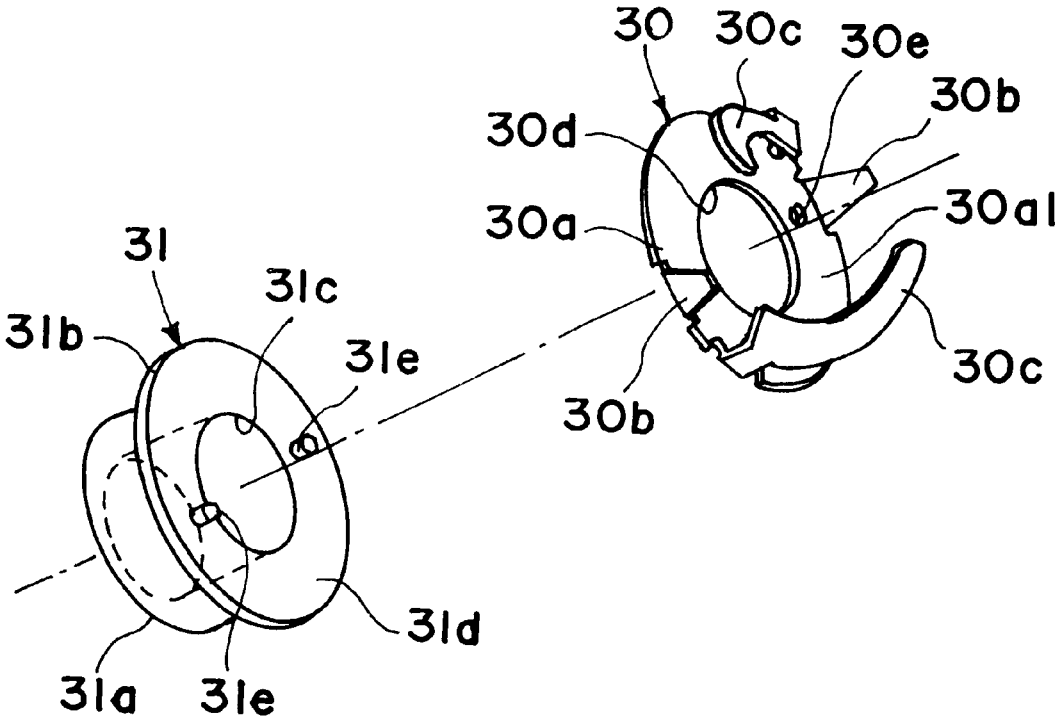
FIG. 4 is a perspective view of a contact support and a sliding contact.
Figure 5:
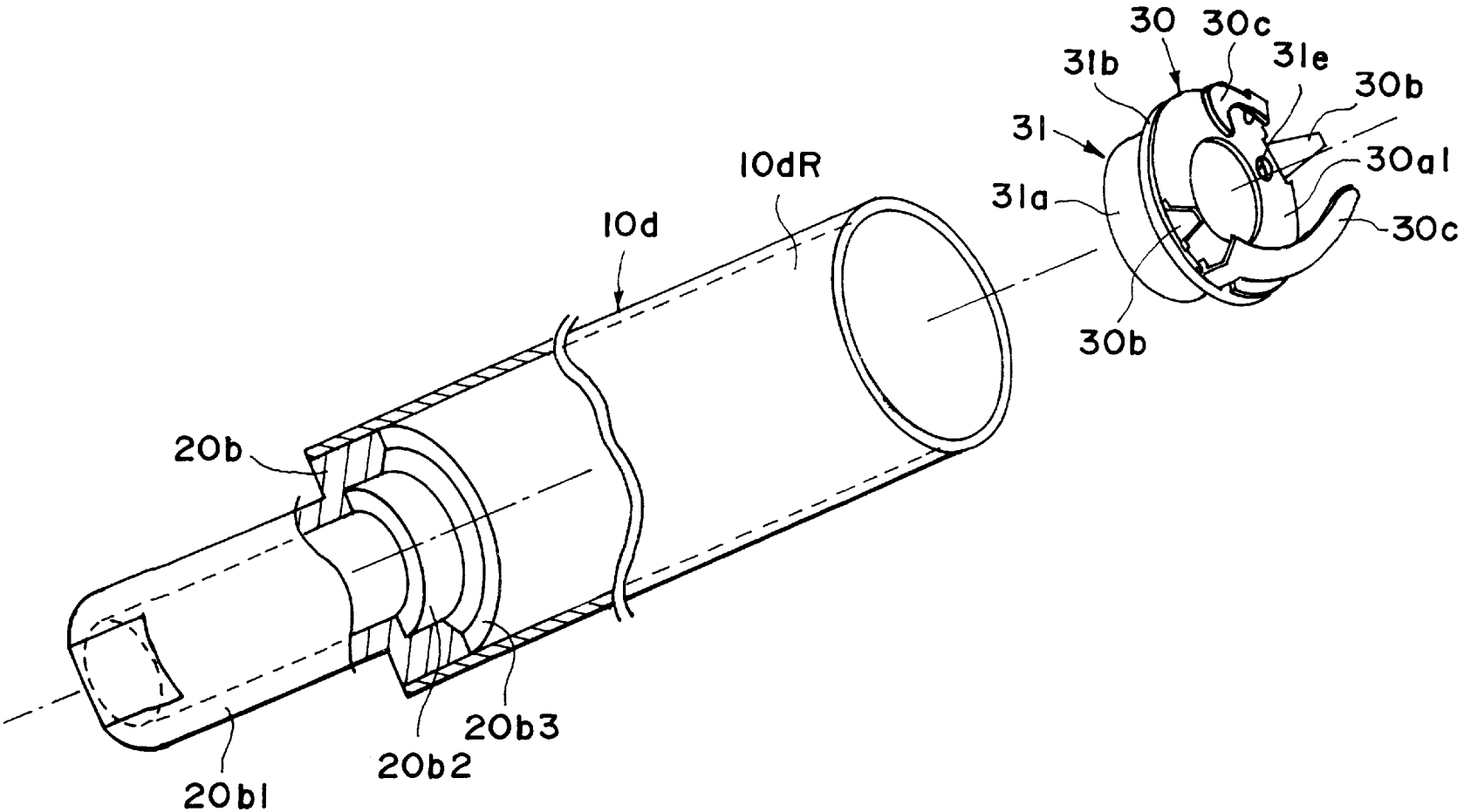
FIG. 5 is a perspective view of the developing roller which is being mounted to the contact support and the sliding contact.

As shown in FIGS. 4 and 5, a sliding contact 30 (second electroconductive portion) is fixed to the contact support 31, and they are inserted into the developing roller 10*d* (FIG. 1).

The contact support 31 comprises a cylindrical portion 31*a*, a flange 31*b*, a center through hole 31*c* formed in the flange 31*b*, and a dowel 31*e* at an end surface 31*d* of the flange 31*b*. The contact support 31 is electrically insulative and is produced from resin material by an injection molding process.

Figure 18:
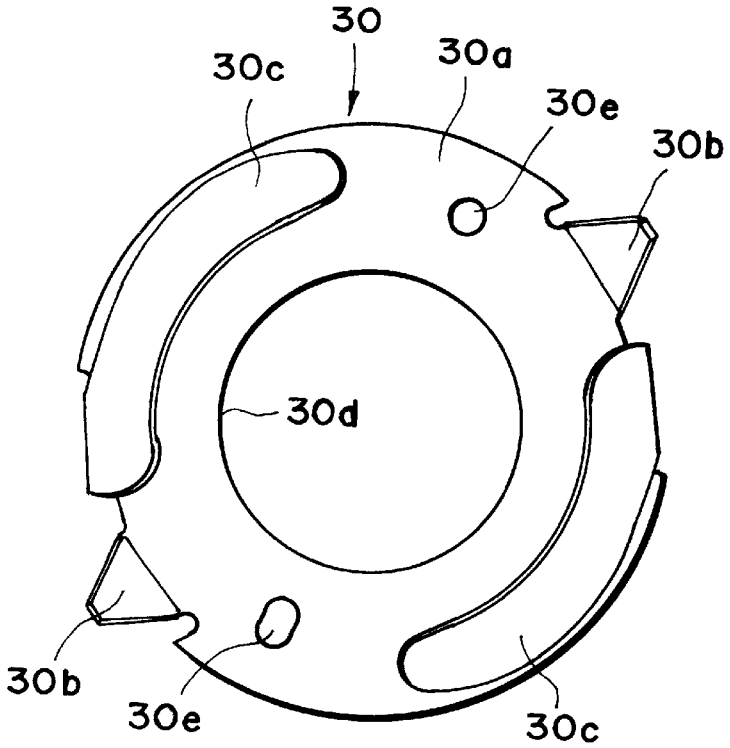
FIG. 18 is a front view of a sliding contact.
Figure 19:
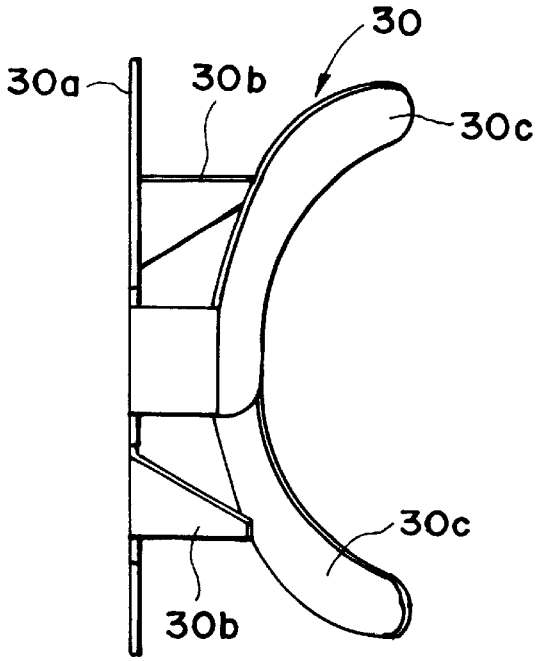
FIG. 19 is a side view of a sliding contact.

The sliding contact 30 is electroconductive, and is used as an electric energy supply part for supplying the developing bias to the developing roller 10*d* from the main assembly 14 of the apparatus. As shown in FIGS. 4, 18 and 19, the sliding contact 30 comprises a disk portion 30*a* as a base closely contacted to the flange 31*b* of the contact support 31, a plurality of (two in this embodiment) claw portions (first contact portion) 30*b* extended in the radial direction of the disk portion 30*a* and that downstream with respect to the inserting direction into the developing roller 10*d*, and two sliding arms (second contact portion) 30*c* extend along a spiral line (unshown) about a line perpendicular to the surface 30*a*1 of the disk portion 30*a* and extending through the center thereof. The base in the form of the disk portion 30*a* is provided at the center with a through hole 30*d* having substantially the same diameter as the through hole 31*c* of the contact support 31, and the disk portion 30*a* is provided with a mounting hole 30*e* for mounting the contact support 31 engageable with the dowel 3l*e* of the contact support 31.

The contact support 31 and the sliding contact 30 are made integral with each other in the following manner. The dowel 31*e* of the contact support 31 is engaged with the mounting hole 30*e* of the sliding contact 30, and the dowel 31*e* is deformed by heat, ultrasonic wave or the like (FIG. 5), by which the sliding contact 30 is fixed to the contact support 31. Here, the mounting hole 30*e* of the sliding contact 30 and the dowel 3l*e* of the contact support 31 are formed such that center of the sliding contact 30 and the center of the contact support 31 are aligned correctly.

The combined structure of the contact support 31 and the sliding contact 30 is inserted into the developing roller 10*d* as shown in FIG. 5. More particularly, the combined structure having the driving side flange member 20*b* at the left-hand end of the developing roller 10*d*, is inserted into the developing roller 10*d* from the right-hand end 10*d*R side which is open, with the contact support 31 side being at the leading end. Then, the combined structure is inserted into the developing roller 10*d* from the end 10*d*R side with the contact support 31 side at the leading side, the cylindrical portion 31*a* of the contact support 31 is engaged with the hole portion 20*b*2 formed coaxially with the shaft portion 20*b*1 in the flange member 20*b*. By doing so, the sliding contact 30 can be disposed coaxially with the developing roller 10*d*. The insertion of the connected article into the developing roller 10*d* stops by the flange 31*b* of the contact support 31 abutting to the inner end surface 20*b*3 before the inner hole portion 20*b*2 of the flange member 20*b*. The sliding contact 30 having been inserted into the developing roller 10*d* is contacted to the inner wall surface (inner surface) 10*d*1 of the developing roller 10*d* with a contact pressure which is provided by deformation of the claw portions 30*b*. Here, the claw portions 30*b* are extended in the radial direction of the disk portion 30*a* and is bent upstream with respect to the inserting direction into the developing roller 10*d*, and are easily flexed during the insertion, and simultaneously, when the force is applied in the pulling- out direction, the ends of the claw portions bite into the inner wall surface 10*d*1. Therefore, the claw portions 30*b* function as a retention member for the sliding contact 30 relative to the developing roller 10*d*.

(Connection of the Developing Roller with the Magnet)

As described in the foregoing, the developing roller 10*d* is a single part which contains the sliding contact 30 therein and electrically conducted with the sliding contact 30. The magnet 10*c* is a single part containing the cylindrical electrode 28 at the left-hand shaft portion 10*c*1 and the fixed contact 29 fixed to the shaft base portion 10*c*5 at the left-hand shaft portion 10*c*1. The two single parts are connected with each other in the following manner.

Figure 6:
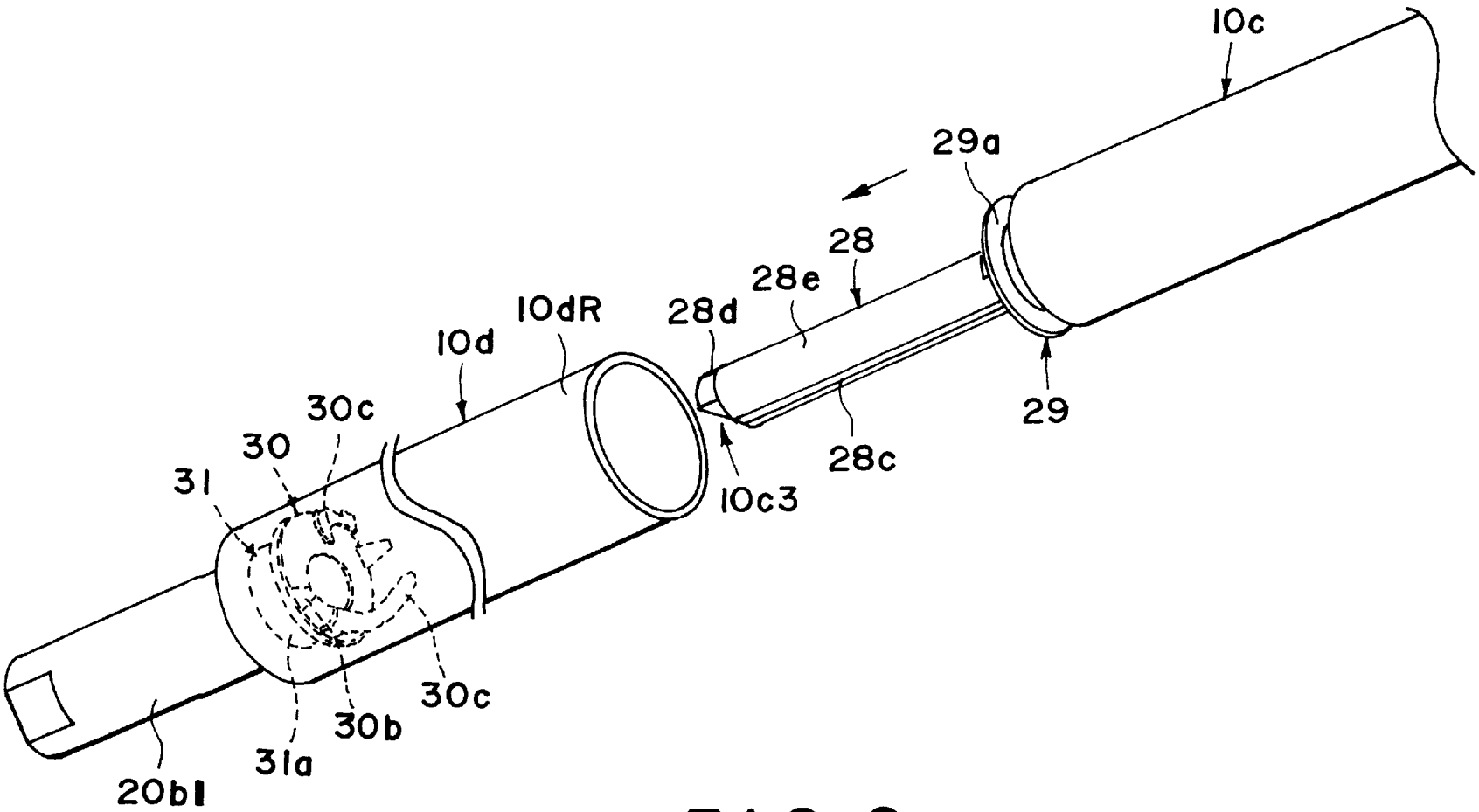
FIG. 6 is a perspective view in which the developing roller assembled with the contact support and the sliding contact and the cylindrical electrode and the fixed contact which are being assembled with the developing roller.

As shown in FIG. 6, the magnet 10*c* is inserted into the developing roller 10*d* at the right-hand end 10*d*R side which is open with the left-hand shaft portion 10*c*1 having the cylindrical electrode 28 at the leading side. Then, the sliding arm 30*c* of the sliding contact 30 is contacted to the disk surface 29*a*1 of the disk portion 29*a* of the fixed contact 29 (FIG. 3). With the further insertion of the magnet 10*c*, the sliding arm 30*c* of the sliding contact 30 is elastically deformed to provide reaction force, but the end surface 10*c*21 of the projection 10*c*2 of the magnet 10*c* (FIG. 3) is contacted to the surface 30*a*1 (FIG. 5) of the disk portion 30*a* of the disk portion 30*a* to indicate the impossibility of further insertion of the magnet 10*c*. The flange member 20*a* is mounted to the right-hand end 10*d*R of the developing roller 10*d* which is open by press-fitting, crimping, heat crimp or the like, by which the developing roller unit DU as shown in FIG. 1 is manufactured. As described in the foregoing, in the developing roller unit DU, the flange member 20*a*, 20*b* are rotatably supported by the bearings 21*a*, 21*b* supported by the toner developing device frame 12 and the holders 24*a*, 24*b*, and are fixed by engagement of the shaft portions 10*c*1 at the opposite ends of the magnet 10*c* with the supporting holes 24*a*1, 24*b*1 of the holders 24*a*, 24*b*. Here, the shaft portion 20*b*1 of the flange member 20*b* covers the cylindrical portion 28*e* leaving the left side projection 28*b* of the cylindrical electrode 28 mounted to the left-hand shaft portion 24*b*1 is D-cut in the shape for angle determination of the magnet 10*c*.

(Third Electroconductive Portion (Fixed Electrode Member))

As shown in FIG. 1, a fixed electrode member 25 as a third electroconductive portion is fixed to the holder 24*b* of the toner developing device frame 12. The holder 24*b* supports the D-cut 10*c*3 at the free end of the left-hand shaft portion 10*c*1 of the magnet 10*c* with which the cylindrical electrode 28 of the developing roller unit DU is engaged by the supporting hole 24*b*1 from the D-cut described above. The fixed electrode member 25 is provided with a contact portion (first electrical contact portion) 25*b* which enters the cut-away portion 24*b*2 which is continued with the supporting hole 24*b*1 in the above-described holder 24*b* at the position adjacent one longitudinal end of the developing roller 10*d* and which is contacted to the projection 28*b* at the left-hand end side of the cylindrical electrode 28. It further comprises an exposed portion (second electrical contact portion) 25*a* which is exposed outwardly for electric connection with the apparatus side contact 26 which is electrically connected with the voltage source of the main assembly 14 of the apparatus.

The contact portion 25*b* and the exposed portion 25*a* are integrally formed.

The contact portion 25*b* functioning as the first electrical contact portion is contacted to the left-hand end side projection 28*b* of the cylindrical electrode 28 to elastically deform, and is contacted to the projection 28*b* with the force provided by the elastic deformation (elastic force). The projection 28*b* at the left-hand end of the cylindrical electrode 28 is designed such that it is disposed on the arcuate surface of the arcuate portion 10*c*31 of the D-cut 10*c*3 provided at the free end of the left-hand shaft portion 10*c*1 to fix the angular position of the magnet 10*c* as described hereinbefore.

More particularly, the projection 28*b* of the cylindrical electrode 28 at the left-hand end side receives a reaction force in the radial direction of the left-hand shaft portion 10*c* from the contact portion 25*b* of the contact portion 25*b*, by which it is urged onto the arcuate surface of the arcuate portion 10*c*31 of the D-cut 10*c*3. By this, the D-cut 10*c*3 of the left-hand shaft portion 10*c*1 is urged toward the flat portion (flat surface portion) 10*c*32 away from the arcuate portion 10*c*31 by the projection 28*b* of the cylindrical electrode 28 through the contact portion 25*b* of the fixed electrode member 25. By doing so, the angle deviation of the magnet 10*c* due to the play between the supporting hole 24*b*1 of the holder 24*b* and the D-cut 10*c*3 of the left-hand shaft portion 10*c*1 of the magnet 10*c*, can be prevented so that supporting accuracy can be improved in the radial direction of the magnet 10*c*.

The sliding arm 30*c* of the sliding contact 30, as described in the foregoing, is shaped into a spiral having an axis of a line perpendicular to the disk portion 30*a* through the center thereof as described in the foregoing, and therefore, the contact pressure provided by contact of the fixed contact 29 to the disk portion 29*a* is in the axial direction of the developing roller 10*d* and the magnet 10*c*. By doing so, the developing roller 10*d* and the magnet 10*c* are movable in the direction away from each other. Therefore, the developing roller 10*d* and the magnet 10*c* move by the amount responded to the play in the axial direction until the axial end is contacted to the bearings 21*a*, 21*b* and/or holders 24*a*, 24*b*. More particularly the sliding arm 30*c* of the sliding contact 30 functions as an urging means for urging the developing roller 10*d* and the magnet 10*c* in the opposite direction along the axis, by which the positional accuracy of the magnet 10*c* in the axial direction is improved. Thus, the positional accuracy of the magnet 10*c* is improved in the axial direction by the sliding arm 30*c* of the sliding contact 30, simultaneously with the improvement of the supporting accuracy in the radial direction of the magnet 10*c* by the contact portion 25*b* of the fixed electrode member 25 described above. As a result, in the developing process of the electrophotographic image forming process, the developing property of the electrostatic latent image is improved when the toner image is formed by applying the developing bias to the developing roller 10*d* to transfer the toner from the surface of the developing roller 10*d* to the photosensitive drum 7 in accordance with the electrostatic latent image formed thereon.

The exposed portion 25*a* as the second electrical contact portion is disposed at a position for contact with the apparatus side contact 26 which is the main assembly side electrical contact connected with the voltage source 27 of the main assembly 14 when the process cartridge B containing the developing roller unit DU is mounted to the main assembly 14 of the apparatus. By doing so, when the process cartridge B is loaded into the main assembly 14 of the apparatus, the exposed portion 25*a* of the fixed electrode member 25 which is exposed to the outside of the holder 24*b* of the toner developing device frame 12, is contacted to the contact 26 connected to the voltage source 27 of the main assembly 14 of the apparatus.

By this, the developing roller 10*d* and the voltage source 27 of the main assembly 14 of the apparatus are electrically connected with each other by way of (1) the contact between the apparatus side contact 26 and the exposed portion 25*a* of the fixed electrode member 25, (2) the contact between the contact portion 25*b* of the fixed electrode member 25 and the left-hand end side projection 28*b* of the cylindrical electrode 28, (3) the projection 28*a* at the right-hand end side of the cylindrical electrode 28 and the claw portion 29*b* of the fixed contact 29 (4) the contact between the disk portion 29*a* of the fixed contact 29 and the sliding arm 30*c* of the sliding contact 30, (5) the electrical path from the claw portion 30*b* of the sliding contact 30 to the inner wall surface 10*d*1 of the developing roller 10*d*. Thus, the application of the developing bias to the developing roller 10*d* is enabled.

Here, the electrical connection between the disk portion 29*a* of the fixed contact 29 and the sliding arm 30*c* of the sliding contact 30 is provided by a sliding contact, and therefore, there is liability that application of the developing bias may be influenced by the wearing of the sliding contact portion of the sliding contact (the sliding portion between the disk portion 29*a* and the sliding arm 30*c*) and by the damage of the sliding contact portion or the like, and it is preferable to apply electroconductive grease thereto. In such a case, the present environment is desirable in that sliding contact portion is disposed inside developing roller 10*d* so that it does not interfere with the mounting operation of the developing roller unit DU to the toner developing device frame 12. In addition, the leakage of the electroconductive grease to the outside of the developing roller unit DU is not likely, and the scattered toner or dust are prevented from entering, and therefore, the property of the electroconductive grease can be maintained. Thus, the reliability of the establishment of the electrical conviction between the disk portion 29*a* of the fixed contact 29 and the sliding arm 30*c* of the sliding contact 30, is improved.

The plurality of projections 10*c*2 provided at the base portion of the left-hand shaft portion 10*c*1 of the magnet 10*c* is effective to indicate the completion of insertion of the magnet 10*c* into the developing roller 10*d* when the developing roller unit DU is assembled, as described hereinbefore, and in addition, the following functions are provided.

When an impact is imparted to the developing roller unit DU in the axial direction (the axial direction of the developing roller 10*d*) during transportation or the like of the process cartridge B including the developing roller unit DU of the embodiment, the free end surface 10*c*21 of the projection 10*c*3 is abutted to the disk portion 30*a* of the sliding contact 30 fixed to the contact support 31 in the flange member 20*b*. Therefore, the plastic deformation of the sliding arm 30*c* of the sliding contact 30 which may be caused by excessive force, can be prevented. Thus, the electrical contact mechanism of the fixed contact 29 to the disk portion 29*a* using the sliding arm 30*c* of the sliding contact 30 is improved in the reliability.

By the provisions of the plurality of projections 10*c*2 around the base portion of the thin left-hand shaft portion 10*c* of the magnet 10*c*, the diameter of the shaft base portion can be expanded to improve the mechanical strength of the shaft base portion. Accordingly, even if the inpact due to drop-out of the cartridge or the like, the base portion of the left-hand shaft portion 10*c* is protected from being broken. In addition, the cylindrical electrode 28 of metal is engaged in the left-hand shaft portion 10*c*1, and therefore, the strength of the shaft base portion is further improved.

The mounting of the magnet 10*c* of the cylindrical electrode 28 to the left-hand shaft portion 10*c*1 is desirably at a predetermined angle relative to the left-hand shaft portion 10*c*1 in order to assured the electrical connection between the left-hand end side projection 28*b* of the cylindrical electrode 28 and the contact portion 25*b* of the fixed electrode member 25 provided to the holder 24*b*. Therefore, in this embodiment, an erroneous assembling preventing structure is provided to prevent mounting the cylindrical electrode 28 to the left-hand shaft portion 10*c*1 at an angle different from the predetermined angle.

Referring to FIGS. 2, 3, 14 and 16, the description will be made as to the structure.

(Erroneous Assembling Preventing Structure for Mounting of a Cylindrical Electrode to the Left-hand Shaft Portion)

As shown in FIG. 2, to the trailing edge, at the righthand side, of the cylindrical portion 28*e* (engaging portion) of the cylindrical electrode 28, there is provided a projection 28*a* at each of 3 positions, and also, there is provided at each of 3 positions recesses 10*c*22 (engaging portion) between the adjacent projections 10*c*2 at the base portion of the left-hand shaft portion 10*c*1 of the magnet 10*c*, and the projection 28*a* and the recess 10*c*22 are engaged with each other (FIG. 3).

Figure 14:
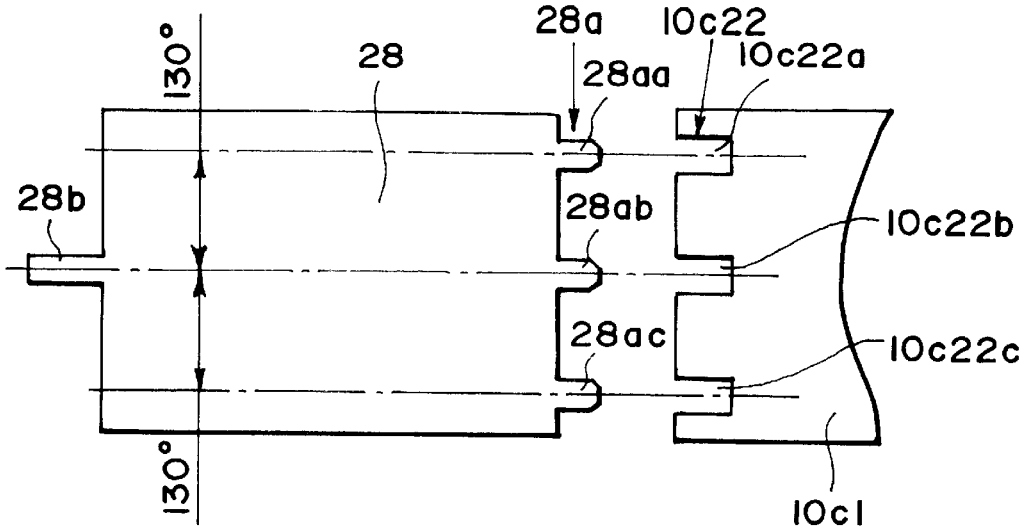
FIG. 14 is a schematic illustration of engaging relation meeting a projection of the cylindrical electrode and a recess of a left-hand shaft portion of the magnet.

FIG. 14 is a schematic view illustrating an engaging relation between the projection 28*a* and the recess 10*c*22. The left side in the Figure, the cylindrical electrode 28 is shown as being expanded, and the righthand side of the Figure similarly shows the projection 10*c*2 and the recess 10*c*22 of the magnet 10*c* which are hypothetically expanded. In FIG. 14, the projection 28*a* as to engaging portion of the cylindrical electrode 28 comprises three projections, namely, a first projection 28*aa*, a second projection 28*ab*, third projection 28*ac*, wherein the righthand side second projection 28*ab* is disposed coaxially with the left-hand projection 28*b* of the cylindrical electrode 28. The gaps among the projections 28*aa*, 28*ab*, 28*ac* are determined such that when the cylindrical electrode 28 is engaged with the left-hand shaft portion 10*c*1 of the magnet 10*c*, the angles as seen from the axis of the left-hand shaft portion 10*c*1 between the first projection 28*aa* and the second projection 28*ab* and between third projection 28*ab* and the third projection 28*ac* are 130 degrees. Therefore, the angle between the third projection 28*ac* and the first projection 28*aa* is 100 degrees.

The recess 10*c*22 as to engaging portion of the magnet 10*c* comprises three recesses, namely, a first recess 10*c*22*a*, a second recess 10*c*22*b*, and a third recess 10*a*22*c*, and gaps among recesses 10*c*22*a*, 10*c*22*b*, 10*a*22*c* are such that angles as seen from the axis of the left-hand shaft portion 10*c*1 between the first recess 10*c*22*a* and the second recess 10*c*22*b* and between the second recess 10*c*22*b* and the third recess 10*a*22*c* are 130 degrees, similarly to the cylindrical electrode 20. Similarly, the angle between the third recess 10*c*22*c* and the first recess 10*c*22*a* is 100 degrees.

Therefore, the positions of the projection 28*a* of the cylindrical electrode 28 and the conditions of the recess 10*c*22 of the left-hand shaft portion 10*c*1 of the magnet 10*c* are aligned of the outer surface of the left-hand shaft portion 10*c*,1 and therefore, the cylindrical electrode 28 can be properly mounted to the left-hand shaft portion 10*c*1.

Figure 15:
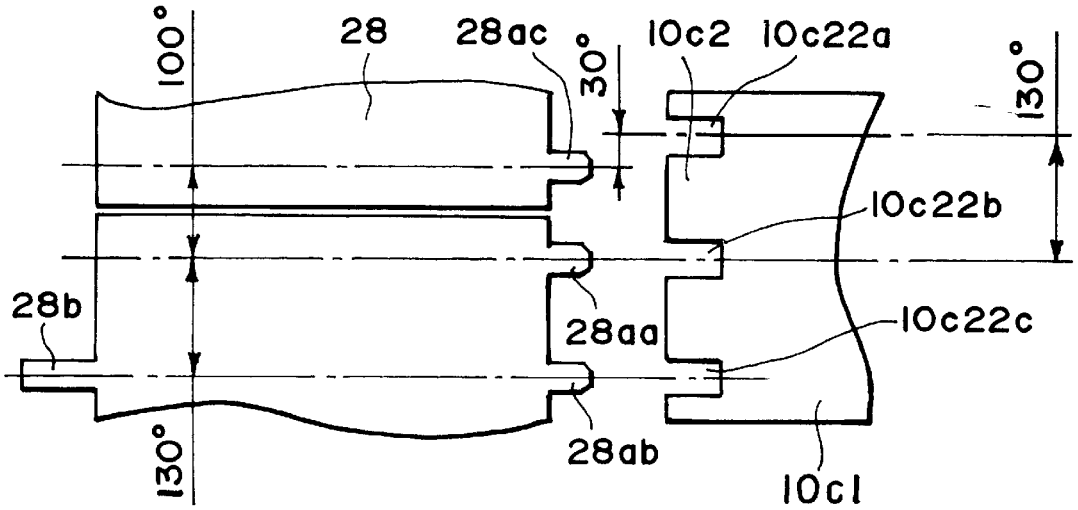
FIG. 15 is a schematic illustration of an erroneous angle between the cylindrical electrode and the left-hand shaft portion of the magnet.

Referring to FIG. 15, a description will be made as to the case in which the mounting angle of the cylindrical electrode 28 to the left-hand shaft portion 10*c*1 is erroneous.

The cylindrical electrode 28 is rotated 130 decrease as seen from the left-hand projection 28*b* side so that second projection 28*ab* of the cylindrical electrode 28 is engaged with the third recess 10*c*22*c* of the left-hand shaft portion 10*c*1.

In this case, the first projection 28*aa* and the second projection 10*c*22*b* are engageable as long as the positional relation is concerned therebetween, but there is a 30 degrees deviation between the third projection 28*ac* and the first recess 10*c*22*a*, because the design is such that angle between the first projection 28*aa* and the second projection 28*ab* and the angle between the second recess 10*c*22*b* and the third recess 10*c*22*c* are 130 degrees. So, if an attempt is made to telescope the cylindrical electrode 28 to the left-hand shaft portion 10*c*1, the third projection 28*ac* abuts the projection 10*c*2 between the first recess 10*c*22*a* and the second recess 10*c*22*b*, so that cylindrical electrode 28 is unable to be moved to the regular position of the left-hand shaft portion 10*c*1.

Although not shown, the cylindrical electrode 28 is rotated from −130 degrees as seen from the left-hand projection 28*b* side in an attempt to engage the third projection 28*ac* of the cylindrical electrode 28 to the first recess 10*c*22*a* of left-hand shaft portion 10*c*1, there is 30 degrees deviation between the first projection 28*aa* and the second recess 10*c*22*b*. For this reason, whether cylindrical electrode 28 is telescoped to the left-hand shaft portion 10*c*1, the first projection 28*aa* abuts the projection 10*c*2 between the first recess 10*c*22*a* and the second recess 10*c*22*b*, so that cylindrical electrode 28 is unable to be moved to the regular position of the left-hand shaft portion 10*c*1.

However, the cylindrical electrode 28 can be inserted to the regular position of the left-hand shaft portion 10*c*1 when the first of the projection 28*aa* is opposed to the first recess 10*c*22*a*, and the second projection 28*ab* is opposed to the second recess 10*c*22*b*, and the third projection 28*ac* is opposed to the third recess 10*a*22*c*, of the outer surface of the left-hand shaft portion 10*c*1. In other words, the cylindrical electrode 28 can be mounted to the left-hand shaft portion 10*c*1 only when the projections 28*aa*, 28*ab*, 28*ac* and the recesses 10*c*22*a*, 10*c*22*b*, 10*c*22*c* of the left-hand shaft portion 10*c*1 of the magnet 10*c* are aligned with each other on the outer surface. Therefore, the correct mounting of the cylindrical electrode 28 to the left-hand shaft portion 10*c*1 is assured.

Figure 16:
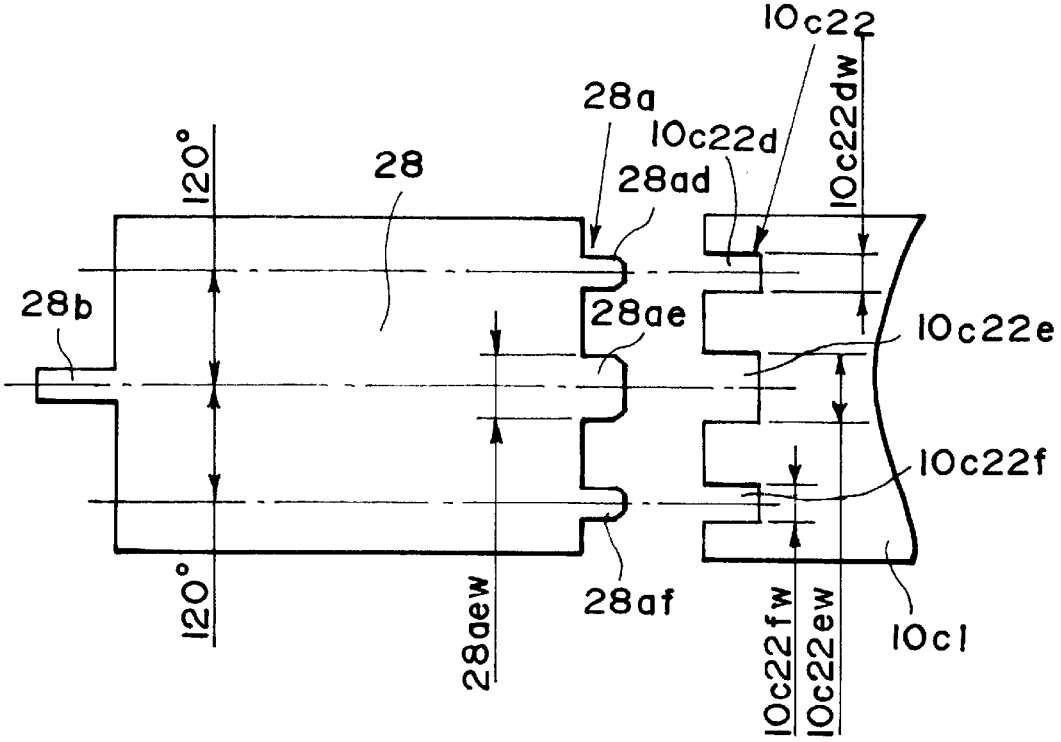
FIG. 16 is a schematic illustration of an engaging relation between a projection of a cylindrical electrode and a recess of a left-hand shaft portion of a magnet according to a modified example.

Referring to FIG. 16, a description will be made as to a further modified example. In FIG. 16, the angles between adjacent ones of the projections 28*ad*, 28*ae*, 28*af* and the angles between adjacent ones of the recesses 10*c*22*d*, 10*c*22*e*, 10*c*22*f* are equal (120 degrees). A width 28*ae*W of the second projection 28*ae* of the three projections 28*ad*, 28*ae*, 28*af* is larger than the widths h 28*ad*W, 28*af*W of the first third projections 28*ad*, 28*af*. Correspondingly, the width 10*c*22*f*W of the second recess 10*c*22*e* of the three recesses 10*c*22*d*, 10*c*22*e*, 10*c*22*f* is larger manner widths h 10*c*22*d*W, 10*c*22*f*W of the first and third recesses 10*c*22*d*, 10*c*22*f*. With the positional relationship among the projections 28*ad*, 28*ae*, 28*af* and the recesses 10*c*22*d*, 10*c*22*e*, 10*c*22*f*, they are all engaged when the three projections and the three recesses are engaged when the positions are aligned on the outer surface of the left-hand shaft portion 10*c*1, and therefore, the cylindrical electrode 28 can be mounted correctly to the left-hand shaft portion 10*c*1, and therefore, the cylindrical electrode 28 can be mounted correctly to the left-hand shaft portion 10*c*1.

However, in the modified example, the width 28*ae*W of the second projection 28*ae* is larger than the widths h 10*c*22*f*W, 10*c*22*d*W of the third recess 10*c*22*f* and the first recess 10*c*22*d*.

$$28ae>>10c22dW,\ 28aeW>10c22dW$$

Therefore, the second projection 28*ae* is unable to engage with either one of the recesses 10*c*22*d*, 10*c*22*f* other than the second recess 10*c*22*e*. Thus, the cylindrical electrode 28 is unable to telescope to the regular position of the left-hand shaft portion 10*c*1 with any angle other than that shown in FIG. 16.

In the modified example, therefore, the cylindrical electrode 28 can be mounted correctly to the left-hand shaft portion 10*c*1 only when the projections 28*ad*, 28*ae*, 28*af* of the are aligned with the recesses 10*c*22*d*, 10*c*22*e*, 10*a*22*f* of the left-hand shaft portion 10*c*1 of the magnet 10*c* on the outer surface of the left-hand shaft portion 10*c1*. By doing so, the cylindrical electrode 28 can be mounted to the left-hand shaft portion 10*c*1 of the cylindrical electrode 28 with correct mounting angle.

In these embodiments, the cylindrical electrode 28 can be mounted to the left-hand shaft portion 10*c*1 only when the projections of the cylindrical electrode 28 are all aligned with the recesses of the left-hand shaft portion 10*c*1 of the magnet 10*c* on the outer surface of the left-hand shaft portion 10*c*1, and therefore, the assembling easiness property of the cylindrical electrode 28 constituting a part of the contact portion for applying the developing bias to the developing roller is improved.

In these embodiments, the mounting angle to the left-hand shaft portion of the cylindrical electrode 28 is determined using the three projections and the three recesses, but the number of the projections and the number of the recesses are not limited to the number of these embodiments.

The above-described developing devices are summarized as follows. A developing device usable with an electrophotographic image forming apparatus (A) to develop an electrostatic latent image formed on an electrophotographic photosensitive member (7):

(a) a frame (toner developing device frame 12);

(b) a developing roller (10*d*) for developing the electrostatic latent image formed on an electrophotographic photosensitive member with a developer (toner);

(c) a magnet (magnet 10*c*) disposed in the developing roller having a shaft at each of one and the other ends, wherein the shaft is extended from an inside of the developing roller to an outside thereof;

(d) a first electroconductive portion extended in the longitudinal direction of one of the shaft at one of ends (left-hand shaft portion 10*c*1), the first electroconductive portion (cylindrical electrode 28) being extended from an inside of the developing roller to an outside thereof;

(e) a second electroconductive portion electrically connecting the first electroconductive portion with an inner surface (inner wall surface 10*d*1), the electroconductive portion being provided in the developing roller;

(f) a third electroconductive portion (fixed electrode member 25) provided in the frame, the third electroconductive portion including a first electrical contact portion (contact portion 25*b*) at one longitudinal end of the developing roller, a second electrical contact portion (exposed portion 25*a*) provided that position different from the position of the first electrical contact portion, for electric connection with a main assembly side electrical contact (apparatus side contact 26) provided in the main assembly 14 of the electrophotographic image forming apparatus when the developing device is mounted to the main assembly 14 of the electrophotographic image forming apparatus, wherein the first electrical contact portion is electrically connected with the first electroconductive portion;

Wherein the first electroconductive portion is electrically connected with the second electroconductive portion in the developing roller, and is electrically connected to the first electrical contact portion in an outside of the developing roller.

The developing roller is provided at its one end with a flange (shaft portion 20*b*1) projected outwardly of the developing roller in the longitudinal direction of the developing roller; The flange covers the outside portion (cylindrical portion 28*e*) of the developing roller 10*d* leaving the free end portion of the first electroconductive portion (left-hand end side projection 28*b*).

The flange is supported rotatably on the frame.

The free end portion of the first electroconductive portion (projection 28*b* at the left-hand end side) is contacted to the first electrical contact portion.

The first electroconductive portion has a cylindrical portion (cylindrical portion 28*e*). The cylindrical is engaged with the shaft.

A projected portion (projection 28*a* at the right-hand end side) projected from a rear end of the cylindrical portion is engaged with a recess (10*c*22) of the shaft. By this, rotation of the cylindrical portion is limited relative to the shaft.

The first electroconductive portion has a disk (disk portion 29*a*) electrically connected with the cylindrical portion. The disk is provided with a hole (29*c*). The shaft benefits the hole.

The second electroconductive portion these fixed inside the developing roller. The second electroconductive portion includes a first contact portion (claw portion 30*b*) contacted to the inner surface of the developing roller 10*d*, and a second contact portion (sliding arm 30*c*) elastically contacted to the first electroconductive portion.

The second contact portion is elastically in sliding contact to the surface (disk portion surface 29*a*1) of a disk contacted electrically to the cylindrical of the first electroconductive. The disk has a hole. The shaft penetrates the hole.

The second contact portion is in sliding contact with a peripheral surface of the cylindrical portion a (disk portion surface 29*a*1) of the first electroconductive portion.

The first the electroconductive portion receives an elastic force in a radial direction of the shaft by the first electrical contact portion.

The free end portion of the prior is D-cut shape. The D-cut shape portion is engaged with a hole (supporting hole 24*b*1)

of the frame. The frame end portion of the first electroconductive portion (the projection 28*b* at the left-hand end) these at an arcuate portion (10*c*31) of the D-cut shape. The 3 end portion of the first electroconductive portion (28) receives an elastic force by the first electrical contact portion in the direction toward the flat portion (10*c*32) of the D-cut shape from the arcuate portion of the D-cut shape.

The first electroconductive portion receives an elastic force in the axial direction of the should by the second electroconductive portion.

The process cartridges (B) of these embodiments are summarized as follows.

(a) an electrophotographic photosensitive member (7);

(b) a frame (toner developing device frame 12);

(c) a developing roller (10*d*) for developing the electrostatic latent image formed on an electrophotographic photosensitive member with a developer (toner);

A magnet (magnet 10*c*) disposed in the developing roller having a shaft at each of one and the other ends, wherein the shaft is extended from an inside of the developing roller to an outside thereof;

A first electroconductive portion extended in the longitudinal direction of one of the shaft at one of ends (left-hand shaft portion 10*c*1), the first electroconductive portion (cylindrical electrode 28) being extended from an inside of the developing roller to an outside thereof;

A second electroconductive portion electrically connecting the first electroconductive portion with an inner surface (inner wall surface lodl), the electroconductive portion being provided in the developing roller;

A third electroconductive portion (fixed electrode member 25) provided in the frame, the third electroconductive portion including a first electrical contact portion (contact portion 25*b*) at one longitudinal end of the developing roller, a second electrical contact portion (exposed portion 25*a*) provided that position different from the position of the first electrical contact portion, for electric connection with a main assembly side electrical contact (apparatus side contact 26) provided in the main assembly 14 of the electrophotographic image forming apparatus when the developing device is mounted to the main assembly 14 of the electrophotographic image forming apparatus, wherein the first electrical contact portion is electrically connected with the first electroconductive portion;

Wherein the first electroconductive portion is electrically connected with the second electroconductive portion in the developing roller, and is electrically connected to the first electrical contact portion in an outside of the developing roller.

The electric energy supply parts (sliding contact 30) of these embodiments are summarized as follows.

An electric energy supply part for supplying developing bias voltage to a developing roller (10*d*) from the main assembly (14) of the electrophotographic image forming apparatus, wherein the developing roller develops an electrostatic latent image formed on an electrophotographic photosensitive member (7) width (7), the developing roller has a magnet (magnet 10*c*) therein;

(a) a base (disk portion 30*a*) having a hole (through hole 30*d*) at the center never, wherein when the electric energy supply part is mounted into the developing roller, a shaft (left-hand shaft portion 10*c*1) of a magnet penetrates the hole;

(b) a first contact portion (claw portion 30*b*) for contacting to the inner surface of the developing roller;

(c) a first electroconductive portion (cylindrical electrode 28) extended along the shaft and a second contact portion (sliding arm 30*c*) for contacting elastically in the axial direction of the shaft.

The first electroconductive portion is electrically connected with the second electroconductive portion in the developing roller, and is electrically connected to the first electrical contact portion in an outside of the developing roller. The first electrical contact portion is disposed at one longitudinal end side of the developing roller. The electrical contact portion is electrically connected with a second electrical contact portion (exposed portion 25*a*) for connection with a main assembly side electrical contact (apparatus side contact 26 connection) provided in the main assembly of the electrophotographic image forming apparatus when the developing device is mounted to the main assembly of the electrophotographic image forming apparatus.

An electric energy supply part for applying a developing bias voltage to the developing roller (10*d*) of the developing device from the main assembly (14) of the electrophotographic image forming apparatus, wherein said developing device develops detachably electrostatic latent image formed on the electrophotographic photosensitive member (7), the electric energy supply part comprising:

(a) (a) a frame (toner developing device frame 12);

(b) a magnet (magnet 10*c*) disposed in the developing roller having a shaft at each of one and the other ends, wherein the shaft is extended from an inside of the developing roller to an outside thereof;

(c) a first electroconductive portion extended in the longitudinal direction of one of the shaft at one of ends (left-hand shaft portion 10*c*1), the first electroconductive portion (cylindrical electrode 28) being extended from an inside of the developing roller to an outside thereof;

(d) a third electroconductive portion (fixed electrode member 25) provided in the frame, the third electroconductive portion including a first electrical contact portion (contact portion 25*b*) at one longitudinal end of the developing roller, a second electrical contact portion (exposed portion 25*a*) provided that position different from the position of the first electrical contact portion, for electric connection with a main assembly side electrical contact (apparatus side contact 26) provided in the main assembly 14 of the electrophotographic image forming apparatus when the developing device is mounted to the main assembly 14 of the electrophotographic image forming apparatus;

the electric energy supply part comprising:

(A) a base(disk portion 30*a*) having a center hole (through hole 30*d*), wherein when the electric energy supply part is mounted into the developing roller, a shaft provided at the one end is penetrated through the hole;

(B) a first contact portion (claw portion 30*b*) for contact to the inner surface of the developing roller;

(C) and a second contact portion (sliding arm 30*c*) for elastic contact with first electroconductive portion (fixed contact 29) extended along the shaft in the axial direction of the shaft.

The base is circular, and the first contact portion is elastic. It is detected outwardly in the radial direction from the peripheral surface of the base.

The second contact portion is elastic. It is detected from the peripheral surface of the base in a direction crossing with the radial direction.

The material of the electric energy supply part is copper alloy, stainless steel alloy or spring steel.

The electric energy supply parts (fixed contact 29) of these embodiments are summarized as follows.

An electric energy supply part for supplying developing bias voltage to a developing roller (10*d*) from the main assembly (14) of the electrophotographic image forming apparatus, wherein the developing roller develops an electrostatic latent image formed on an electrophotographic photosensitive member (7) width (7), the developing roller has a magnet (magnet 10*c*) therein;

(a) a base (disk portion 30*a*) having a hole (through hole 30*d*) at the center never, wherein when the electric energy supply part is mounted into the developing roller, a shaft (left-hand shaft portion 10*c*1) of a magnet penetrates the hole;

(b) a contact portion (claw portion 29*b*) for elastic contact with the first electroconductive portion (cylindrical electrode 28) which is extended in the longitudinal direction of the shaft provided in said base to electrically connect therewith.

The contact portion is extended around the hole, and the contact portion is provided by bending a part of the base.

The contact portion is provided at each of three positions around the hole.

An electric energy supply part for supplying a developing bias to a developing roller (10*d*) of an electric energy supply part from a main assembly (14) of the electrophotographic image forming apparatus, wherein the developing device develops an electrostatic latent image formed on an electrophotographic photosensitive member (7), the developing device comprising:

(a) a frame (toner developing device frame 12);

(b) a magnet (magnet 10*c*) disposed in the developing roller having a shaft at each of one and the other ends, wherein the shaft is extended from an inside of the developing roller to an outside thereof;

(c) a first electroconductive portion extended in the longitudinal direction of one of the shaft at one of ends (left-hand shaft portion 10*c*1), the first electroconductive portion (cylindrical electrode 28) being extended from an inside of the developing roller to an outside thereof;

(d) a third electroconductive portion (fixed electrode member 25) provided in the frame, the third electroconductive portion including a first electrical contact portion (contact portion 25*b*) at one longitudinal end of the developing roller, a second electrical contact portion (exposed portion 25*a*) provided that position different from the position of the first electrical contact portion, for electric connection with a main assembly side electrical contact (apparatus side contact 26) provided in the main assembly 14 of the electrophotographic image forming apparatus when the developing device is mounted to the main assembly 14 of the electrophotographic image forming apparatus;

The electric energy supply part comprising:

(A) a base (disk portion 30*a*) having a center hole (through hole 30*d*), wherein when the electric energy supply part is mounted into the developing roller, a shaft provided at the one end is penetrated through the hole;

(B) a contact portion (claw portion 29*b*) for elastic and electric contact with the first electroconductive portion (cylindrical electrode 28) extended in the longitudinal direction of said shaft provided in said base, wherein the contact portion is extended around the hole, and the contact portion is provided by bending a part of the base.

The contact portion is provided at each of three positions around the hole.

The developing roller and the electrophotographic photosensitive member are unified into a cartridge which is mounted in a process cartridge which is detachably mountable to the main assembly of the electrophotographic image forming apparatus.

The base is circular. The hole is circular. A movement in a circumferential direction of the base is limited by engagement of the contact portion to the shaft. The material of the electric energy supply part is copper alloy, stainless steel alloy or spring steel. #

As described in the foregoing, with the developing device and the process cartridge, the sliding contact portion is provided within the developing roller 10*d* by the fixed contact 29 and the sliding contact 30, so that sliding contact portion is protected from dust or other foreign matter. Additionally, when the electroconductive grease is applied to the sliding contact portion for the purpose of improvement of the reliability in the sliding contact portion, the electroconductive grease is protected from insurance of dust or foreign matter, so that reliability of the sliding contact portion is improved, because the possible deterioration of the performance of the electroconductive grease is prevented.

Furthermore, the sliding arm 30*c* of the sliding contact 30 constituting the sliding contact portion is contacted to be disk portion 29*a* of the fixed contact 29 in the axial direction of the developing roller 10*d*, and therefore, the magnet 10*c* supported of the toner developing device frame 12 with play in the axial direction of the developing roller 10*d* is urged unidirectionally in the axial election in the toner developing device frame 12 on which it is supported, so that positional accuracy of the magnet 10*c* relative to the toner developing device frame 12 is improved.

Moreover, the D-cut 10*c*3 of the left-hand shaft portion 10*c*1 of the magnet 10*c* is urged toward the flat portion 10*c*32 from the arcuate portion 10*c*31 by the projection 28*b* of the cylindrical electrode 28 through the contact portion 25*b* of the fixed electrode member 25, so that play in the engagement between the supporting hole 24*b*1 of the holder 24*b* and the D-cut 10*c*3 of the left-hand shaft portion 10*c*1 of the magnet 10*c* in the radial direction of the magnet 10*c*. Therefore, the accuracy of positioning of the magnet 10*c* relative to the holder 24*b* is improved.

Since the sliding contact 30 is fixed flange member 20*b* through the insulative contact support 31 having the cylindrical portion 31*a* engaged with the hole 20*b*1 of the flange member 20*b* and the through-hole 31*c* through which the left-hand shaft portion 10*c*1 of the magnet l0*c* penetrates, the sliding contact 30 can be disposed coaxially with the rotation axis of the developing roller 10*d*, and the sliding track of the sliding contact 30 relative to the fixed contact 29 can be made a circle coaxial with the rotation axis of the developing roller. Therefore, the sliding motion of the sliding contact 30 relative to the fixed contact 29 is stabilized, and therefore, the reliability of the sliding contact portion is improved.

The cylindrical electrode 28 is telescoped to the left-hand shaft portion 10*c*1 to such that left-hand end side projection 28*a* is engaged with the recess 10*c*22 between the adjacent projections 10*c*2 provided at the base portion of the left-hand shaft portion 10*c*1 of the magnet 10*c*, and therefore, the indexing, in the rotational direction, of the cylindrical electrode 28 relative to the left-hand shaft portion 10*c*1 of the magnet 10*c* (the correct positioning of the cylindrical electrode 28 in the rotational angle of the developing roller 10*d*) is possible. Therefore, the contact between the projection 28*a* of the cylindrical electrode 28 and the claw portion 29*b* of the fixed contact 29 is assured.

In addition, the projected portion 28*a* projected from the trailing edge of the cylindrical electrode 28 is engaged with the recess 10*c*22 provided at the base portion of the left-hand shaft portion 10*c*1 of the magnet 10*c*, and the projected portion 28*a* and the recess 10*c*22 are constituted such that mounting angle (positioning in the circumferential direction) of the cylindrical electrode 28 relative to the left-hand shaft portion 10*c*1, and therefore, the cylindrical electrode 28 can be mounted to the left-hand shaft portion 10*c*1 at correct mounting angle. The outer diameter of the projection 10*c*2 provided at the base portion of the left-hand shaft portion 10*c*1 of the magnet 10*c* is larger than the outer diameter of the projection 28*a* provided at the right-hand end side of the cylindrical portion 28*e* of the cylindrical electrode 28 and is smaller the then rotation track of the sliding contact portion between the sliding arm 30*c* of the sliding contact 30 and the disk portion 29*a* of the fixed contact 29, and therefore, the sliding contact portion between the sliding arm 30*c* of the sliding contact 30 and the disk portion 29*a* of the fixed contact 29 can be protected by the projection 10*c*2 of the magnet 10*c*, and in addition, the sliding function between the sliding arm 30*c* of the sliding contact 30 and then disk portion 29*a* of the fixed contact 29 is not deteriorated. In addition, the strength of the shaft base portion of the magnet 10*c* is improved.

The projection 10*c*2 provided at the base portion of the left-hand shaft portion 10*c*1 of the magnet 10*c* is determined such that height of the projection 10*c*2 measured in the axial direction when the fixed contact 29 is closely contacted to the shaft base portion 10*c*5 is higher than the free end of the claw portion of the claw portion 29*a* of the fixed contact 29, and therefore, even if the process cartridge B receives impact during transportation thereof, in the axial direction of the developing roller 10*d*, the free end surface 10*c*2 of the projection 10*c*2 is abutted to the disk portion 30*a* of the sliding contact 30. Therefore, the contact portion between the fixed contact 29 and the cylindrical electrode 28 is protected, and in addition, the sliding contact portion between the sliding arm 30*c* of the sliding contact 30 and the disk portion 29*a* of the fixed contact 29 is protected from receiving excessive force. #

The fixed contact 29 is assuredly connected electrically with the cylindrical electrode 28, since the left-hand shaft portion 10*c*1 of the magnet 10*c* penetrates the through hole 29*c* of the through hole 29*c*, and claw portions 29*b* disposed around the through hole 29*c* are elastically contacted to the cylindrical electrode 28 extended in the longitudinal direction of the left-hand shaft portion 10*c*1 to be electrically connected to the cylindrical electrode 28.

The sliding contact 30 comprises the through hole 10*d* through which the left-hand shaft portion 10*c* of the magnet 10*c* penetrates, the disk portion 30*a* formed around the through hole 10*d*, a plurality of claw portions 30*b* extended radially outwardly from the disk portion 30*a* and bent toward downstream with respect to the inserting direction of the magnet 10*c* to be contacted to the inner wall surface 10*d*1 of the developing roller 10*d*, and the sliding arm 30*c* extended in a spiral line about a line perpendicular to the surface 30*a*1 of the disk through the center of the disk portion 30*a* and elastically contacted to the disk portion 29*a* of the fixed contact 29. Since the sliding arm 30*c* is elastically contacted to the disk portion 29*a* of the fixed contact 29, so that magnet 10*c* can be urged in the axial direction of the developing roller 10*d* through the fixed contact 29, and therefore, the play in the axial direction of the magnet 10*c* relative to the developing roller 12*d* can be eliminated, thus improving the positional accuracy of the magnet 10*c*. Additionally, even if a force is applied in such a direction that sliding contact 30 is away from the inside of the developing roller 10*d*, the force against it is provided, and furthermore, the electrical connection with the developing roller 10*d* is assured. Since the contact pressure between the sliding arm 30*c* and the disk portion 29*a* of the fixed contact 29 is imparted substantially in the axial direction of the developing roller 10*c*, so that contact support 31 can be closely contacted to the inner end surface 20*b*3 of the flange member 20*b* by the urging of the magnet 10*c* in the axial direction and the reaction.

Figure 12:
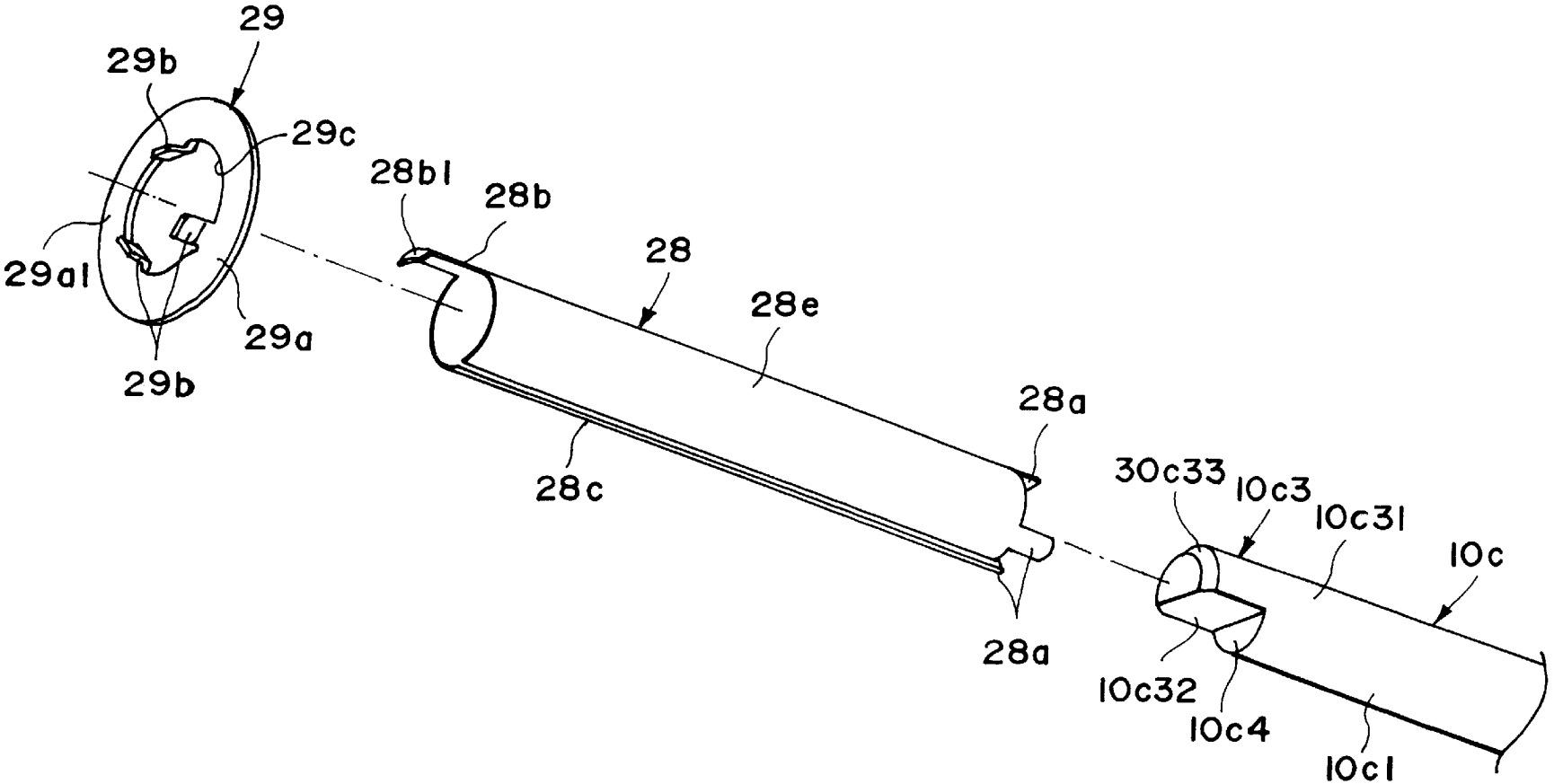
FIG. 12 is an illustration of a cylindrical electrode according to a modified example.
Figure 13:
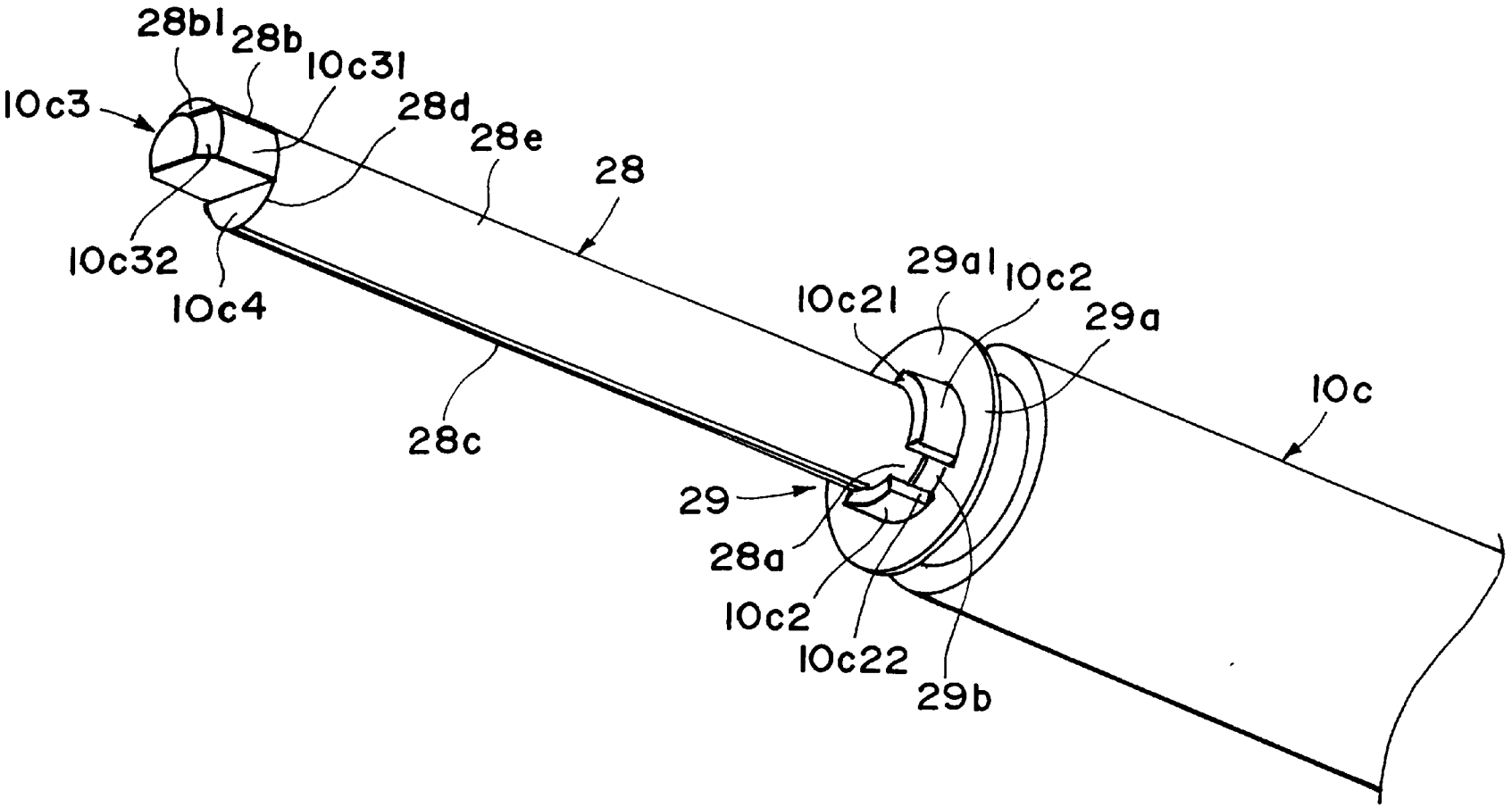
FIG. 13 is a perspective view of the cylindrical electrode and fixed contact shown in FIG. 12 assembled with the magnet

In the foregoing embodiments, the projection 28*b* at the left side of the cylindrical electrode 28 is parallel with the arcuate portion 30*c*31 of the D-cut 10*c*3 of the magnet 10*c* (FIG. 2), but as shown in FIGS. 12 and 13, the end of the projection 28*b* of the cylindrical electrode 28 may be bent inwardly into a bent portion 28*b*1, which is locked to the beveling portion 30*c*33 provided at the free end of the arcuate portion 30*c*31 of the D-cut 10*c*3 of the magnet 10*c*. By doing so, the movement of the cylindrical electrode 28 relative to left-hand shaft portion 10*c*1 of the magnet 10*c* can be assuredly prevented, and in addition, the end surface 28*d* of the cylindrical portion 28*e* can be easily aligned with the bottom surface 10*c*4 of the left-hand shaft portion 10*c*1.

(Other Embodiments)

In the foregoing embodiments, the developing device and/or the electric energy supply part are used for a process cartridge for forming a monochromatic image, but the developing device and/or the electric energy supply part according to the present invention are usable with a cartridge for forming multi color images (2color image, 3color image, full-color or the like) in which a plurality of the developing means are provided.

In the foregoing, the process cartridge has been described as being for formation of a monochromatic image, but the process cartridge is is usable for multi-color image (2color image, 3color image or full-color) in which a plurality of developing means are provided. #

In the above-described embodiment, the electrophotographic photosensitive member has been described as photosensitive drum, but the electrophotographic photosensitive member is not limited to such a photosensitive drum, but the following is usable. The photosensitive member may be a photoconductor which may be an amorphous silicon, amorphous selenium, zinc oxide, titanium oxide, organic photoconductor (OPC) or the like. The photosensitive member may be in the form of a drum, a belt or another rotatable member, or a sheet, or the like. Generally, however, a drum or a belt is used, and in the case of a drum type photosensitive member, a cylinder of aluminum alloy or the like is coated with a photoconductor by evaporation or application or the like.

The structure of the charging means described in the foregoing is of a so-called contact type charging method, but a known charging means comprising a tungsten wire which is enclosed width metal shield of aluminum or the like at three sides, wherein positive or negative ions generated by application of a high voltage to said tungsten wire are directed to the surface of the photosensitive drum to uniformly charged the surface, is usable. The charging means may be a roller type as described in the foregoing, a blade type (charging blade), a pad type, a block type, a rod type, a wire type or the like.

As for a cleaning method for removing toner remaining on the photosensitive drum, a blade, a fur brush, a magnetic brush or the like is usable.

The process cartridge, for example, comprises an electrophotographic photosensitive member and at least one process means. As for the types of the process cartridge, there are, in addition to those disclosed hereinbefore, a type in which, for example, an electrophotographic photosensitive member, a developing means and a charging means are unified integrally into a cartridge which is detachably mountable to the main assembly of the electrophotographic image forming apparatus, a type in which an electrophotographic photosensitive member and a developing means are unified integrally into a cartridge which is detachably mountable to a main assembly of apparatus, a type in which an electrophotographic photosensitive member, a developing means, a charging means and cleaning means are unified integrally into a cartridge which is detachably mountable to a main assembly of an electrophotographic image forming apparatus, they tied in which an electrophotographic photosensitive member and two or more of the process means are combined integrally into a cartridge which is detachably mountable to a main assembly of an electrophotographic image forming apparatus.

The process cartridge may contain an electrophotographic photosensitive member and at least one of charging means, developing means and cleaning means as a unit which constitutes a cartridge which is detachably mountable to a main assembly of an electrophotographic image forming apparatus. The process cartridge is mounted to or demounted from the main assembly of the apparatus by the user. This means that maintenance of the apparatus is carried out, in effect, by the user.

In the foregoing environment, a laser beam printer has been described in the foregoing as an example of the electrophotographic image forming apparatus, but the present invention is not limited thereto, and the present invention is applicable to an electrophotographic copying machine, a facsimile machine, a facsimile machine or the like of an electrophotographic type.

While the invention has been described with reference to the structures disclosed herein, it is not confined to the details set forth and this application is intended to cover such modifications or changes as may come within the purpose of the improvements or the scope of the following claims.

What is claimed is:

1. A developing apparatus comprising:

a frame;

a developer carrying member for carrying a developer to develop an electrostatic image formed on an image bearing member, said developer carrying member including a first cylindrical portion and a second cylindrical portion provided at an end of said first cylindrical portion and supported by a bearing portion;

a magnet provided in said developer carrying member, said magnet being extended from inside of said developer carrying member to outside thereof;

a first electroconductive portion supported on said magnet and extended from inside of said developer carrying member to outside thereof;

a second electroconductive portion provided in said developer carrying member and electrically connected with an inner surface of said first cylindrical portion and in slidable contact with said first electroconductive portion inside said developer carrying member;

a third electroconductive portion including a first electrical contact portion electrically connected with said first electroconductive portion outside of said developer carrying member and a second electrical contact portion disposed at a position different from said first electrical contact portion and electrically connected with an electrical contact of a main assembly of an image forming apparatus;

when a developing bias is applied to said developer carrying member from the electrical contact of the main assembly of the image forming apparatus by way of said third electroconductive portion, said second electroconductive portion and said first electroconductive portion.

2. An apparatus according to claim 1, wherein said second cylindrical portion is a flange member.

3. An apparatus according to claim 2, wherein said flange member is rotatably supported on said frame.

4. An apparatus according to claim 1, wherein said first electrical contact portion is contacted to an end of the first electroconductive portion.

5. An apparatus according to claim 1, wherein said first electroconductive portion is provided with a cylindrical portion, and is engaged with a shaft of said magnet.

6. An apparatus according to claim 5, wherein said first electroconductive portion is provided with a projected portion projected from the cylindrical portion, and the projected portion is engaged with a recess provided in a shaft of said magnet to limit rotation of said cylindrical portion relative to said magnet.

7. An apparatus according to claim 5, wherein said first electroconductive portion is provided with a disk portion electrically connected to the cylindrical portion, and said disk portion is provided with a hole through which a shaft of said magnet penetrates.

8. An apparatus according to claim 1, wherein said second electroconductive portion is fixed in said developer carrying member, and said second electroconductive portion includes a first contact portion contacted to said first cylindrical portion and a second contact portion elastically contacted to said first electroconductive portion.

9. An apparatus according to claim 8, wherein said first electroconductive portion is provided with a disk portion which is electrically connected to said first cylindrical portion, and said disk portion is provided with a hole through which a shaft of said magnet penetrates, and said second contact portion elastically slides relative to said disk portion.

10. An apparatus according to claim 8, wherein said second contact portion slides on a peripheral surface of said first cylindrical portion.

11. An apparatus according to claim 1, wherein said first electroconductive portion receives an elastic force in a radial direction of said first cylindrical portion by said first electrical contact portion.

12. An apparatus according to claim 1, wherein an end of a shaft of said magnet is provided with a D-cut shape portion having an arcuate portion and a flat surface portion, and said D-cut shape portion is supported on said frame, and wherein an end of said first electroconductive portion receives elastic force in a direction toward said flat surface portion away from said arcuate portion by said first electrical contact portion.

13. An apparatus according to claim 1, wherein said first electroconductive portion receives elastic force in the longitudinal direction of said developer carrying member by said second electroconductive portion.

14. An apparatus according to claim 1, wherein said first electroconductive portion is supported on a shaft of said magnet, and said second electroconductive portion is fixed in said developer carrying member, and wherein said first electroconductive portion and said second electroconductive portion are contacted in a longitudinal direction of said developer carrying member by insertion of said magnet into said developer carrying member.

15. An apparatus according to claim 1, wherein said first electroconductive portion is provided at its end with an engaging portion engaged with an engaging portion provided in a shaft of said magnet, by engagement between engaging portions of said first electroconductive portion and the shaft, a mounting angle of said first electroconductive portion a relative to the shaft of said magnet in a circumferential direction is determined.

16. A process cartridge detachably mountable to a main assembly of an image forming apparatus, said process cartridge comprising:

an image bearing member;

a frame;

a developer carrying member for carrying a developer to develop an electrostatic image formed on said image bearing member, said developer carrying member including a first cylindrical portion and a second cylindrical portion provided at an end of said first cylindrical portion and supported by a bearing portion;

a magnet provided in said developer carrying member, said magnet being extended from inside of said developer carrying member to outside thereof;

a first electroconductive portion supported on said magnet and extended from inside of said developer carrying member to outside thereof;

a second electroconductive portion provided in said developer carrying member and electrically connected with an inner surface of said first cylindrical portion and in slidable contact with said first electroconductive portion inside said developer carrying member;

a third electroconductive portion including a first electrical contact portion electrically connected with said first electroconductive portion outside of said developer carrying member and a second electrical contact portion disposed at a position different from said first electrical contact portion and electrically connected with an electrical contact of a main assembly of an image forming apparatus;

when a developing bias is applied to said developer carrying member from the electrical contact of the main assembly of the image forming apparatus by way of said third electroconductive portion, said second electroconductive portion and said first electroconductive portion.

17. A process cartridge according to claim 16, wherein said second cylindrical portion is a flange member.

18. A process cartridge according to claim 17, wherein said flange member is rotatably supported on said frame.

19. A process cartridge according to claim 16, wherein said first electrical contact portion is contacted to an end of the first electroconductive portion.

20. A process cartridge according to claim 16, wherein said first electroconductive portion is provided with a cylindrical portion, and is engaged with a shaft of said magnet.

21. A process cartridge according to claim 20, wherein said first electroconductive portion is provided with a projected portion projected from the cylindrical portion, and the projected portion is engaged with a recess provided in a shaft of said magnet to limit rotation of said cylindrical portion relative to said magnet.

22. A process cartridge according to claim 20, wherein said first electroconductive portion is provided with a disk portion electrically connected to the cylindrical portion, and said disk portion is provided with a hole through which a shaft of said magnet penetrates.

23. A process cartridge according to claim 16, wherein said second electroconductive portion is fixed in said developer carrying member, and said second electroconductive portion includes a first contact portion contacted to said first cylindrical portion and a second contact portion elastically contacted to said first electroconductive portion.

24. A process cartridge according to claim 23, wherein said first electroconductive portion is provided with a disk portion which is electrically connected to said first cylindrical portion, and said disk portion is provided with a hole through which a shaft of said magnet penetrates, and said second contact portion elastically slides relative to said disk portion.

25. A process cartridge according to claim 23, wherein said second contact portion slides on a peripheral surface of said first cylindrical portion.

26. A process cartridge according to claim 16, wherein said first electroconductive portion receives an elastic force in a radial direction of said first cylindrical portion by said first electrical contact portion.

27. A process cartridge according to claim 16, wherein an end of a shaft of said magnet is provided with a D-cut shape portion having an arcuate portion and a flat surface portion, and said D-cut shape portion is supported on said frame, and wherein an end of said first electroconductive portion receives elastic force in a direction toward said flat surface portion away from said arcuate portion by said first electrical contact portion.

28. A process cartridge according to claim 16, wherein said first electroconductive portion receives elastic force in the longitudinal direction of said developer carrying member by said second electroconductive portion.

29. A process cartridge according to claim 16, wherein said first electroconductive portion is supported on a shaft of said magnet, and said second electroconductive portion is fixed in said developer carrying member, and wherein said first electroconductive portion and said second electroconductive portion are contacted in a longitudinal direction of said developer carrying member by insertion of said magnet into said developer carrying member.

30. A process cartridge according to claim 16, wherein said first electroconductive portion is provided at its end with an engaging portion engaged with an engaging portion provided in a shaft of said magnet, by engagement between engaging portions of said first electroconductive portion and the shaft, a mounting angle of said first electroconductive portion a relative to the shaft of said magnet in a circumferential direction is determined.

31. An electric energy supply part to be provided in a voltage application path for applying a developing bias to a developer carrying member from a main assembly of an image forming apparatus, wherein said developer carrying member develops an electrostatic image formed on an image bearing member with a developer, and said developer carrying member has a first cylindrical portion, a second cylindrical portion provided at an end of said first cylindrical portion and supported by a bearing portion and a magnet therein, said electric energy supply part comprising:

a base portion provided with a center hole, wherein a shaft of said magnet penetrates said hole;

a first contact portion contacted to an inner surface of said first cylindrical portion;

a second contact portion elastically contacted in a longitudinal direction of said developer carrying member to an electroconductive portion extended along said shaft and supported on said shaft of said magnet.

32. An electric energy supply part according to claim 31, wherein said electric energy supply part is rotatable together with said developer carrying member and slidable on said electroconductive portion at said second contact portion.

33. An electric energy supply part according to claim 31, wherein said base portion is provided with a circle-like portion, and said first contact portion is elastic and projected outwardly from a peripheral surface of said base portion in a radial direction.

34. An electric energy supply part according to claim 33, wherein said second contact portion is elastic and is projected from a peripheral surface of said base portion in a direction crossing with a radial direction.

35. An electric energy supply part to be provided in a voltage application path for applying a developing bias to a developer carrying member from a main assembly of an image forming apparatus, wherein said developer carrying member develops an electrostatic image formed on an image bearing member with a developer, and said developer carrying member has a first cylindrical portion, a second cylindrical portion provided at an end of said first cylindrical portion and supported by a bearing portion and a magnet therein, said electric energy supply part comprising:

a base portion provided with a center hole, wherein a shaft of said magnet penetrates said hole;

a contact portion elastically contacted with an electroconductive portion provided along said shaft supported on a shaft of said magnet.

36. An electric energy supply part according to claim 35, wherein said contact portion is provided along a peripheral surface of the hole and is bent and extended from said base portion.

37. An electric energy supply part according to claim 36, wherein a plurality of such said contact portions are providing along the peripheral surface of the hole.

38. An electric energy supply part according to claim 35, wherein a circumferential direction movement of a base portion relative to said shaft is limited by engagement of said contact portion with a shaft of said magnet.

* * * * *

UNITED STATES PATENT AND TRADEMARK OFFICE

CERTIFICATE OF CORRECTION

PATENT NO. : 6,336,012 B1
APPLICATION NO. : 09/559144
DATED : January 1, 2002
INVENTOR(S) : Shinya Noda et al.

It is certified that error appears in the above-identified patent and that said Letters Patent is hereby corrected as shown below:

COLUMN 3:

Line 39, “withdeveloper” should read --with developer--.

COLUMN 5:

Line 7, “righthand” should read --right-hand--.

COLUMN 7:

Line 10, “10c,1” should read --10c1,--.

COLUMN 11:

Line 18, “inpact” should read --impact--.

COLUMN 12:

Line 15, “10c,1” should read --10c1,--; and
Line 20, “decrease” should read --degrees--.

COLUMN 13:

Line 14, “10c1, and therefore, the cylindrical” should read --10c1.--;
Line 15, “electrode 28 can be mounted correctly to the left-hand shaft” should be deleted; and
Line 16, “portion 10c1.” should be deleted.

COLUMN 15:

Line 28, “1od1),” should read --10d1),--.

COLUMN 16:

Line 22, “(a)(a)” should read --(a)--.

COLUMN 18:

Line 9, “steel.#” should read --steel.--.

UNITED STATES PATENT AND TRADEMARK OFFICE

CERTIFICATE OF CORRECTION

PATENT NO. : 6,336,012 B1
APPLICATION NO. : 09/559144
DATED : January 1, 2002
INVENTOR(S) : Shinya Noda et al.

It is certified that error appears in the above-identified patent and that said Letters Patent is hereby corrected as shown below:

COLUMN 19:

Line 15, “the then” should read --than the--.

COLUMN 20:

Line 35, “is is” should read --is--; and
Line 37, “provided.#” should read --provided.--.

COLUMN 22:

Line 3, “when” should read --wherein--.

COLUMN 23:

Line 41, “when” should read --wherein--.

COLUMN 24:

Line 61, “portion;” should read --portion; and--.

COLUMN 26:

Line 2, “hole;” should read --hole; and--; and
Line 14, “viding” should read --vided--.

Signed and Sealed this

Nineteenth Day of February, 2008

JON W. DUDAS
*Director of the United States Patent and Trademark Office*